US012486752B1

(12) United States Patent
Hunter

(10) Patent No.: US 12,486,752 B1
(45) Date of Patent: Dec. 2, 2025

(54) MONITORING HYDRAULIC FRACTURING OF A WELL USING PRESSURE WAVES

(71) Applicant: Halliburton Energy Services, Inc., Houston, TX (US)

(72) Inventor: Timothy Holiman Hunter, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/804,708

(22) Filed: Aug. 14, 2024

Related U.S. Application Data

(60) Provisional application No. 63/654,571, filed on May 31, 2024, provisional application No. 63/654,764, filed on May 31, 2024.

(51) Int. Cl.
*E21B 43/26* (2006.01)
*E21B 49/00* (2006.01)

(52) U.S. Cl.
CPC ..... *E21B 43/2607* (2020.05); *E21B 49/00* (2013.01)

(58) Field of Classification Search
CPC ..... E21B 43/26; E21B 43/2607; E21B 49/00
See application file for complete search history.

(56) References Cited

U.S. PATENT DOCUMENTS 1,134,197 A 4/1915 Henederson
2,915,122 A 12/1959 Hulse
5,093,811 A 3/1992 Mellor et al.
7,114,560 B2 10/2006 Nguyen et al.
7,413,010 B2 8/2008 Blauch et al.
9,581,004 B2 2/2017 Ciezobka et al.
9,879,514 B2 1/2018 Ciezobka et al.
9,982,523 B2 5/2018 Ciezobka et al.
10,018,025 B2 7/2018 Ciezobka
10,196,886 B2 2/2019 Tolman et al.
10,487,638 B2 11/2019 Ciezobka et al.
10,683,739 B2 6/2020 Nguyen et al.
10,947,967 B1 * 3/2021 Surjaatmadja ..... E21B 43/267
11,143,005 B2 10/2021 Dusterhoft et al.
11,293,276 B2 4/2022 Searles et al.
(Continued)

FOREIGN PATENT DOCUMENTS

CN 109564296 B 3/2021

OTHER PUBLICATIONS

Specification and Drawings for U.S. Appl. No. 63/654,764, filed May 31, 2024, entitled "Data Processing for Evaluating Subsurface Conditions in a Wellbore," 532 pages.
(Continued)

*Primary Examiner* — Brad Harcourt
(74) *Attorney, Agent, or Firm* — Conley Rose, P.C.; Rodney B. Carroll

(57) ABSTRACT

A system for monitoring hydraulic fracturing of a well includes an apparatus configured to generate a pressure wave in a wellbore of the well. The pressure wave causes a response from a formation surrounding the wellbore. The system further includes a sensor configured to detect the response and output a signal based on the detected response. The system further includes a processor configured to receive the signal and analyze the signal to determine a characteristic of the formation. A fracking operation of the well is altered based on the determined characteristic.

23 Claims, 12 Drawing Sheets

(56) References Cited

U.S. PATENT DOCUMENTS

| | | | | |
|---|---|---|---|---|
| 11,352,868 | B2 | 6/2022 | Beisel et al. | |
| 11,376,058 | B2 | 7/2022 | Ward et al. | |
| 11,560,792 | B2 | 1/2023 | Zhang et al. | |
| 11,668,174 | B2 | 6/2023 | Beuterbaugh et al. | |
| 11,725,507 | B2 | 8/2023 | Gordon et al. | |
| 11,840,912 | B1 | 12/2023 | Weightman et al. | |
| 12,123,298 | B1 * | 10/2024 | Bland | E21B 43/119 |
| 2004/0206494 | A1 | 10/2004 | Stephenson et al. | |
| 2015/0175873 | A1 | 6/2015 | Milam et al. | |
| 2016/0281484 | A1 | 9/2016 | Lestz et al. | |
| 2017/0314379 | A1 | 11/2017 | Guidry | |
| 2018/0320514 | A1 | 11/2018 | Felkl et al. | |
| 2019/0316447 | A1 | 10/2019 | Oehring et al. | |
| 2020/0308958 | A1 | 10/2020 | Kabannik | |
| 2021/0032967 | A1 | 2/2021 | Dusterhoft et al. | |
| 2021/0140312 | A1 * | 5/2021 | Dumoit | G01V 1/133 |
| 2022/0074293 | A1 | 3/2022 | Hunter et al. | |
| 2022/0082004 | A1 | 3/2022 | Bannikov et al. | |
| 2023/0058311 | A1 | 2/2023 | Haustveit et al. | |
| 2023/0119075 | A1 | 4/2023 | Hall et al. | |
| 2023/0147476 | A1 | 5/2023 | Wheelock et al. | |
| 2023/0392482 | A1 | 12/2023 | Dusterhoft et al. | |
| 2024/0146040 | A1 | 5/2024 | Martin et al. | |

OTHER PUBLICATIONS

Foreign Communication from Related Application—International Search Report and Written Opinion of the International Searching Authority, International Application No. PCT/US2024/053385, dated Feb. 20, 2025, 12 pages.

Specification and Drawings for U.S. Appl. No. 63/690,391, filed Sep. 4, 2024, entitled "Hydraulic Fracturing With Modulating Injection Flow Rate," 115 pages.

Specification and Drawings for U.S. Appl. No. 18/962,875, filed Nov. 27, 2024, entitled "Hydraulicfracturing With Modulating Injection Flow Rate," 123 pages.

Specification and Drawings for U.S. Appl. No. 19/056,363, filed Feb. 18, 2025, entitled "Hydraulic Fracturing With Modulating Injection Flow Rate," 145 pages.

Specification and Drawings for U.S. Appl. No. 63/654,571, filed May 31, 2024, entitled "Monitoring Hydraulic Fracturing of a Well Using Pressure Waves," 57 pages.

Specification and Drawings for U.S. Appl. No. 63/733,847, filed Dec. 13, 2024, entitled "Hydraulic Fracturing With Modulating Injection Flow Rate," 144 pages.

Foreign Communication from Related Application—International Search Report and Written Opinion of the International Searching Authority, International Application No. PCT/US2025/010578, dated Apr. 24, 2025 10 pages.

Foreign Communication from Related Application—International Search Report and Written Opinion of the International Searching Authority, International Application No. PCT/US2025/023418, dated Jul. 16, 2025, 11 pages.

* cited by examiner

MONITORING HYDRAULIC FRACTURING OF A WELL USING PRESSURE WAVES

CROSS-REFERENCE TO RELATED APPLICATIONS

The present application claims priority to U.S. Provisional Patent Application No. 63/654,571 filed on May 31, 2024, and U.S. Provisional Patent Application No. 63/654,764 filed on May 31, 2024, both of which are hereby incorporated by reference in their entirety.

STATEMENT REGARDING FEDERALLY SPONSORED RESEARCH OR DEVELOPMENT

Not applicable.

INCORPORATION BY REFERENCE

The contents of the following patents are incorporated herein by reference in their entirety: U.S. Pat. Nos. 11,346,197, 11,143,005, and 11,373,058.

BACKGROUND

Monitoring hydraulic fracturing progress can be challenging. According to the conventional art, radionuclide and microseismic monitoring have been used. However, these methods have shortcomings. For example, radionuclide monitoring may present environmental hazards due to the use of radioactive material. Microseismic monitoring may have a high degree of error. The system and method of the present disclosure may address one or more of these shortcomings.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
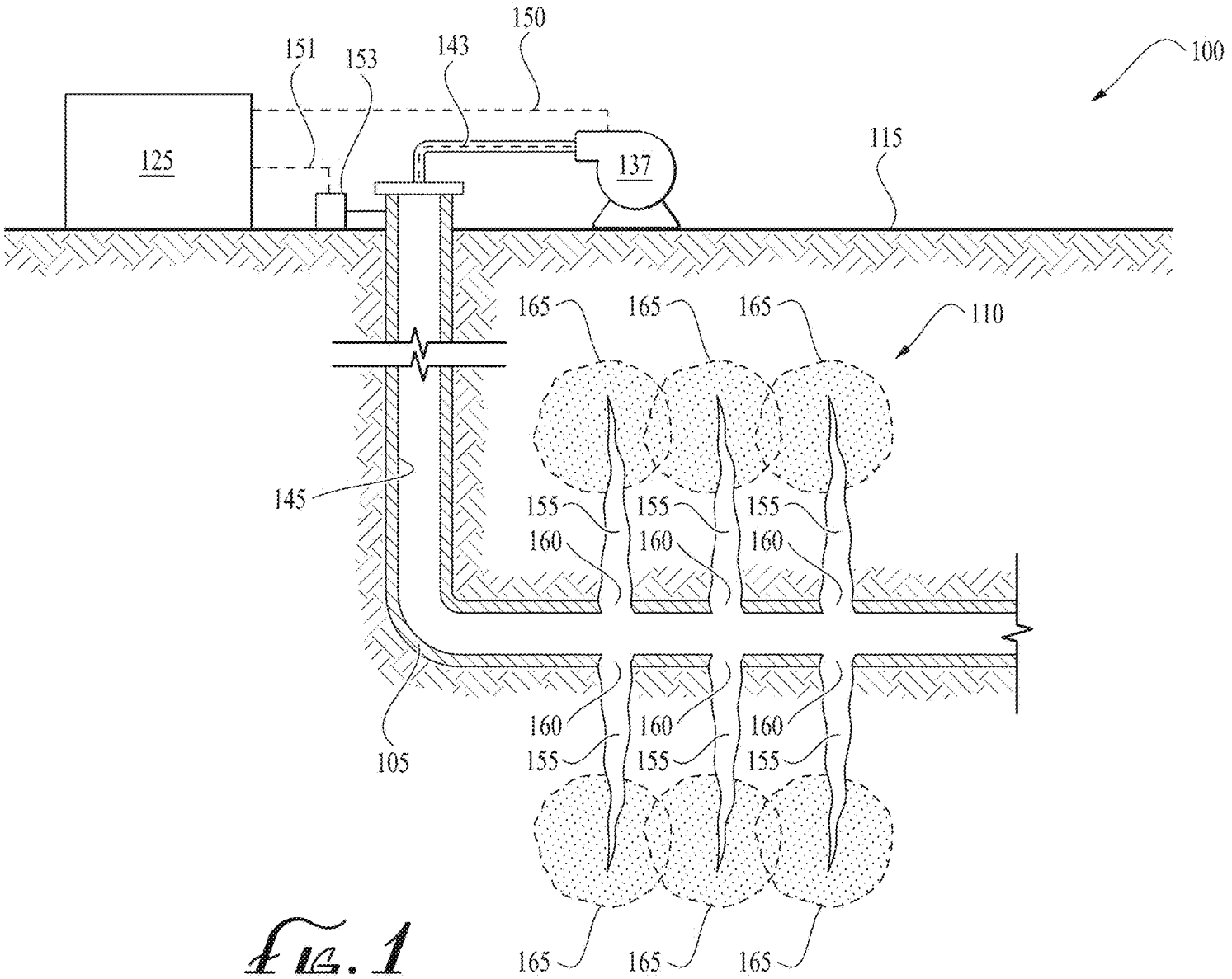
FIG. 1 is a schematic diagram of an exemplary well system, according to an embodiment of the present disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid, for example relative to flow of well fluid in the well. As used herein, orientation terms "upstream," "downstream," are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid.

The present disclosure is related to equipment and methods to induce pressure pulses by means of fluid flow modulation. Such pulses can be used for well bore and formation diagnostics. Other forms of fluid flow profiles can also be generated through various modulation schemes. Pressure pulse modulation may be analyzed to help better understand wellbore and formation characteristics. Equipment for generating the pulses may be configured and controlled to generate the desired flow and/or pressure profiles. Diagnostics can provide insights into stimulation effectiveness.

Pressure in a well is a function of fluid flow rate since the well acts as a variable restriction. Fluid rate variations into a well bore can be used to generate various pressure responses which can be used to help determine characteristics of the well bore and surrounding formations. Such pressure waves can be initiated by surface pumping equipment including electrical power generation units, well servicing pumps, blenders, manifolding, flow-pulsing devices, and/or flow-control devices. A single pump may be used, or a plurality of pumps can be used to further expand flow/pressure pulsing and/or modulation capabilities. In some embodiments, other responses can be detected, such as seismic, acoustic, and/or any other types of responses that are caused by the pressure wave input through the fluid in the wellbore.

FIG. 1 illustrates an exemplary well system 100. The well system 100 may include a wellbore 105 in a subterranean formation 110 beneath a ground surface 115. The wellbore 105 may include a horizontal wellbore. The well system may include any combination of horizontal, vertical, slant, curved, and/or other wellbore orientations. Additionally, wellbore 105 may be disposed or positioned in a subsea environment. The well system 100 may include one or more additional treatment wells, observation wells, or other types of wells. A processor 125 be located at the wellbore 105 or at another location. The processor 125 may be or may be part of a controller, a computer, a control station, or any other apparatus designed to receive, processes, and output information. The processor 125 may be located at a data processing center, a computing facility, or another suitable location.

The subterranean formation 110 may include a reservoir that contains hydrocarbon resources, such as oil, natural gas, or others. For example, the subterranean formation 110 may include all or part of a rock formation (for example, shale, coal, sandstone, granite, or others) that contains natural gas. The subterranean formation 110 may include naturally fractured rock or natural rock formations that are not fractured to a significant degree. In one or more embodiments, the subterranean formation 110 may include tight gas formations that include low permeability rock (for example, shale, coal, or others).

The well system 100 may comprise a pump system 137. The pump system 137 may be used to perform an injection treatment, whereby fluid is injected into the subterranean formation 110 through the wellbore 105. In some embodiments, the injection treatment may fracture and/or stimulate part of a rock formation or other materials in the subterranean formation 110. In such embodiments, fracturing the rock may increase the surface area of the formation, which may increase the rate at which the formation conducts fluid resources to the wellbore 105. For example, a fracture treatment may augment the effective permeability of the rock by creating high permeability flow paths that permit native fluids (for example, hydrocarbons) to flow out of the reservoir rock into the fracture and flow through the reservoir to the wellbore 105. The processor 125 may utilize selective fracture valve control, information on stress fields around hydraulic fractures, real time fracture mapping, real time fracturing pressure interpretation, and/or combinations thereof to control the pump system 137 to achieve desirable complex fracture geometries in the subterranean formation 110.

The pump system 137 may inject a treatment fluid into the subterranean formation 110 from the wellbore 105. The pump system 137 may comprise one or more electrically driven pumps and/or one or more engine (e.g., gas) driven pumps. The pump system 137 may be disposed on a truck. The pump system 137 may apply injection treatments that include, for example, a multi-stage fracturing treatment, a single-stage fracture treatment, a mini-fracture test treatment, a follow-on fracture treatment, a re-fracture treatment, a final fracture treatment, other types of fracture treatments, and/or any combination thereof. The pump system 137 may be one of multiple pump systems configured to collectively execute the injection treatment.

In some embodiments, the pump system 137 may have any suitable range of revolutions per minute and may not require the use of a transmission. The pump system 137 may be manually operated, controlled by the processor 125, and/or combinations thereof. The pump system 137 may inject fluid 143 into the wellbore 105 at or near the level of the ground surface 115. The fluid 143 may be pumped through the wellbore 105 from the ground surface 115 level by a conduit 145 installed in the wellbore 105. The conduit 145 may include casing cemented to the wall of the wellbore 105. In some embodiments, all or a portion of the wellbore 105 may be left open, without casing. The conduit 145 may include a working string, coiled tubing, sectioned pipe, and/or other types of conduit.

The processor 125 may be disposed on an instrument truck, for example, a mobile vehicle, an immobile installation, or any other suitable structure. The processor may be a controller, for example, that controls and/or monitors the injection treatment applied by the pump system 137. The processor may be any type of computer, digital system, and/or analog system. The processor 125 may be in communication with the pump system 137 via a communication link 150. The communications link 150 may comprise a direct or indirect, wired or wireless connection. In some embodiments, the communication link 150 allows the processor 125 to communicate with the pump system 137. In some embodiments, the communication link 150 allows the processor 125 to communicate with other equipment at the ground surface 115.

A sensor 153 may be disposed at the surface 115. Additional sensor(s) may be disposed downhole. The sensor 153 may measure pressure. The sensor 153 may be a discreet sensor or it may be a continuous sensor, such as a fiber optic sensing system. In some embodiments, the sensor 153 and/or other sensors may measure pressure, flow rate, fluid density, temperature, and/or other parameters of treatment and/or production. For example, the sensor 153 may include one or more pressure meters or other equipment that measures the pressure of fluid 143 in the wellbore 105 at or near the ground surface 115 and/or at other locations such as downhole. In some embodiments, a communication link 151 allows the sensor 153 to send data to and/or communicate with the processor 125. The sensor 153 may be located at or near the well head. The sensor 153 may be a surface gauge. In some embodiments, the sensor 153 is a fiber optic system (e.g., distributed acoustic sensor) distributed through the well.

Hydraulic pressure by the pump system 137 may fracture the subterranean formation 110. The one or more fractures 155 may include one or more fractures of any length, shape, geometry or aperture, that extend from one or more perforations 160 along the wellbore 105 in any direction or orientation. The one or more fractures 155 may be formed by one or more hydraulic injections at multiple stages or intervals, at different times or simultaneously. The one or more fractures 155 may extend from the wellbore 105 and terminate in the subterranean formation 110. The one or more fractures 155 may extend through one or more regions that include one or more natural fracture networks 165, one or more regions of un-fractured rock, or both. In the illustrated embodiment, the one or more fractures 155 may intersect the one or more natural fracture networks 165.

The processor 125 may be configured to control the pump system 137, wherein the processor 125 may be programmed with a suitable algorithm, software application and/or one or more executable instructions to modulate the injection rate during a hydraulic fracture treatment to control one or more aspects of fracture growth. The processor 125 may instruct the pump system 137 to adjust or alter the injection flow rate to effectively produce simple and planar fracture growth and/or complex and branched fracture growth.

Multiple methods can be used to generate pressure waves during wellbore treatments. These methods may include, but not limited to, pump valve manipulation, omitted pump valves, selectable pump by-pass circuits, pump unloading devices, and pump rate modulation. Pump flow rate modulation can include changing parameters such as discharge flow rate, ramp-rate (the rate at which flow rate is changed) and/or starting/stopping of pumps. For example, the flow rate of the pump system 137 may be modulated to generate a pressure wave inside the wellbore 105.

In some embodiments, a dedicated pulsing device is used. The dedicated pulsing device can also be used in conjunction with the pump system 137 to modulate flow/pressure. Similarly, the pump system 137 pumps may have specialized valves and/or plungers to generate pulsing flow. In some embodiments, the flow rate changes are near-instantaneous. In some embodiments, the flow rate changes take place over several minutes. The faster the change, the more drastic the related pressure pulse may be. Sharp, near-instantaneous pressure pulses can be used for diagnostic methods. Longer flow rate modulation may be used to interact with a formation. In some embodiments, the pump system 137 may output a pressure wave at the natural frequency of the formation 110. In some embodiments, diversion aids are used to close off portions of the well bore that is taking fluid. Diversion materials can include viscous liquids, granular or shaped solids (such as perforation ball sealers).

There may be continuously variable rate changes to follow a desired flow/pressure profile. The flow/pressure profile may range from very simple linear ramped rate changes to complex geometric forms. In some embodiments, the pump system 137 does not stop but only changes rate. The more abruptly the flow rate of the pump system 137 changes, the stronger the pressure inflection that can be generated. Some pump types can start and stop more quickly than others. For instance, engine-driven pumps can often stop more quickly than electrically driven pumps. Therefore, engine driven pumps can be used to suddenly stop or change flow rate very rapidly to cause sharp pressure waves even to the point of causing a "water-hammer." Electric pumping units may have the advantage of being able to generate virtually infinitely-variable flow rate within their rate capability ranges. This is in contrast to engine-driven pumps that may have to shift transmission ranges to move from one flowrate to another.

Figure 2:
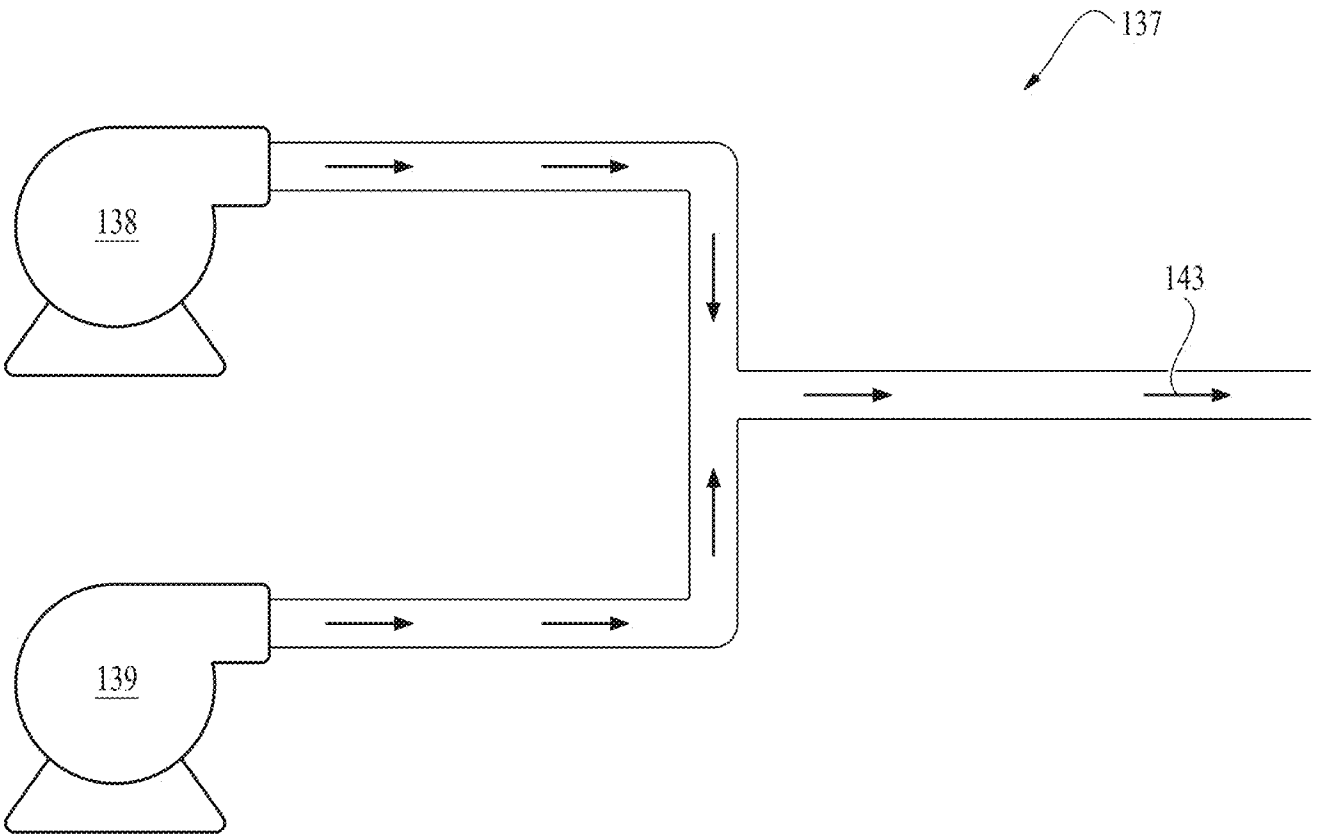
FIG. 2 is a schematic diagram of an exemplary pump system, according to an embodiment.

In some embodiments, combinations of electrically driven pumps and engine-driven pumps can be used to gain the benefits of both quick inflections and higher rangeability without shifting gears. For example, FIG. 2 shows the pump system 137, which may comprise an electrically driven pump 138 and an engine driven pump 139. The pumps 138,139 may be fluidly coupled in parallel and may be in fluid communication with the wellbore 105. To achieve the desired flow rate, both pumps 138,139 may work together. To achieve a rapid decrease in flow rate, the engine driven pump 139 may be stopped or sharply reduced in speed. The electrically driven pump 138 may also be slowed but not to the same extent as the engine driven pump 139. The electrically driven pump 138 may vary flow rate with a smoothness and/or a complexity beyond the capability of the engine driven pump 139. The flow rate of the engine driven pump 139 may also be varied according to its capability. Stopping an electric pump too suddenly could cause the electric pump to overspeed (e.g., the pump may go over the control window) or cause a voltage will spike because the amperage is no longer being consumed. The engine driven pump 139 may have the capability to stop more suddenly than the electrically driven pump 138.

The systems and methods described herein may be used for controlling an injection treatment. For example, the injection treatment may be modified by modulating the flow rate of the treatment fluid with the pump system 137. Without limitations, the amplitude, frequency, and/or rate function may be varied to enable variable modulation. Modulating the flow rate in real-time may create a pressure response that enables pressure diagnostics that can be relied upon to improve fracture growth parameters (e.g., near the wellbore and far field growth), wellbore conditions, and/or well performance. In some embodiments, the electrically driven pump 138 may be actuated to increase or decrease the flow rate. The pressure response may be measured by the sensor 153. The diagnostics (e.g., parameters) can include perforation quality, cluster efficiency, formation connectivity, and/or number of openings.

The system for monitoring hydraulic fracturing of a well may include an apparatus (e.g., the pump system 137) that may generate a pressure wave in the wellbore 105 of the well. The pressure wave may reflect off of the formation 110 surrounding the wellbore 105 (e.g., cause a pressure response off of the formation 110). The sensor 153 may detect the reflected pressure wave (e.g., pressure response) and output a signal based on the detected pressure waves. The processor 125 may receive the signal, analyze the signal to determine a characteristic of the formation 110, and/or output the determined characteristic. A fracking operation of the well system 100 may be altered based on the determined characteristic.

In some embodiments, the apparatus may include an electrical power generator, a pump, a blender, a manifold, a flow-pulsing device, and/or a flow control device. The apparatus may include an electrically driven pump 138 and the pressure wave may be generated by modulating a flow rate output by the electrically driven pump 138. The apparatus may comprise an engine driven pump 139 and the pressure wave may be generated by modulating a flow rate output by the engine driven pump 139. The engine driven pump 139 may be disposed at a surface 115 of the well and/or the electric driven pump 138 may be disposed at the surface 115 of the well. A combined output of the engine driven pump and the electric driven pump may form the pressure wave. The pressure wave may be at a natural frequency of the formation 110. The pressure wave may be generated by modulating amplitude, frequency, phase-shift, rate-of-change flow, wave form shape, duration, and/or period. The apparatus may be disposed at a surface 115 of the well, the formation 110 may be disposed proximate to a horizontal portion of the wellbore 105, and the apparatus may be configured to fracture the formation 110. The processor 125 may be further configured to analyze the signal by comparing the signal to a model, and control a rate at which the pump injects fluid into the well based on a result of the comparison. The characteristic may be a degree of fracturing of the formation.

In some embodiments, pressure pulses may be generated for the purpose of creating a response in the formation. A return signal may be listened to and that return signal may be used to determine something about the well based on how the signal is reflected from the formation. The modulation (e.g., pressure wave) can cause a response that can be detected. The resultant signal from the modulation may be received. The liquid may be used as a communication medium (e.g., the fluid carries the signal).

Figure 3:
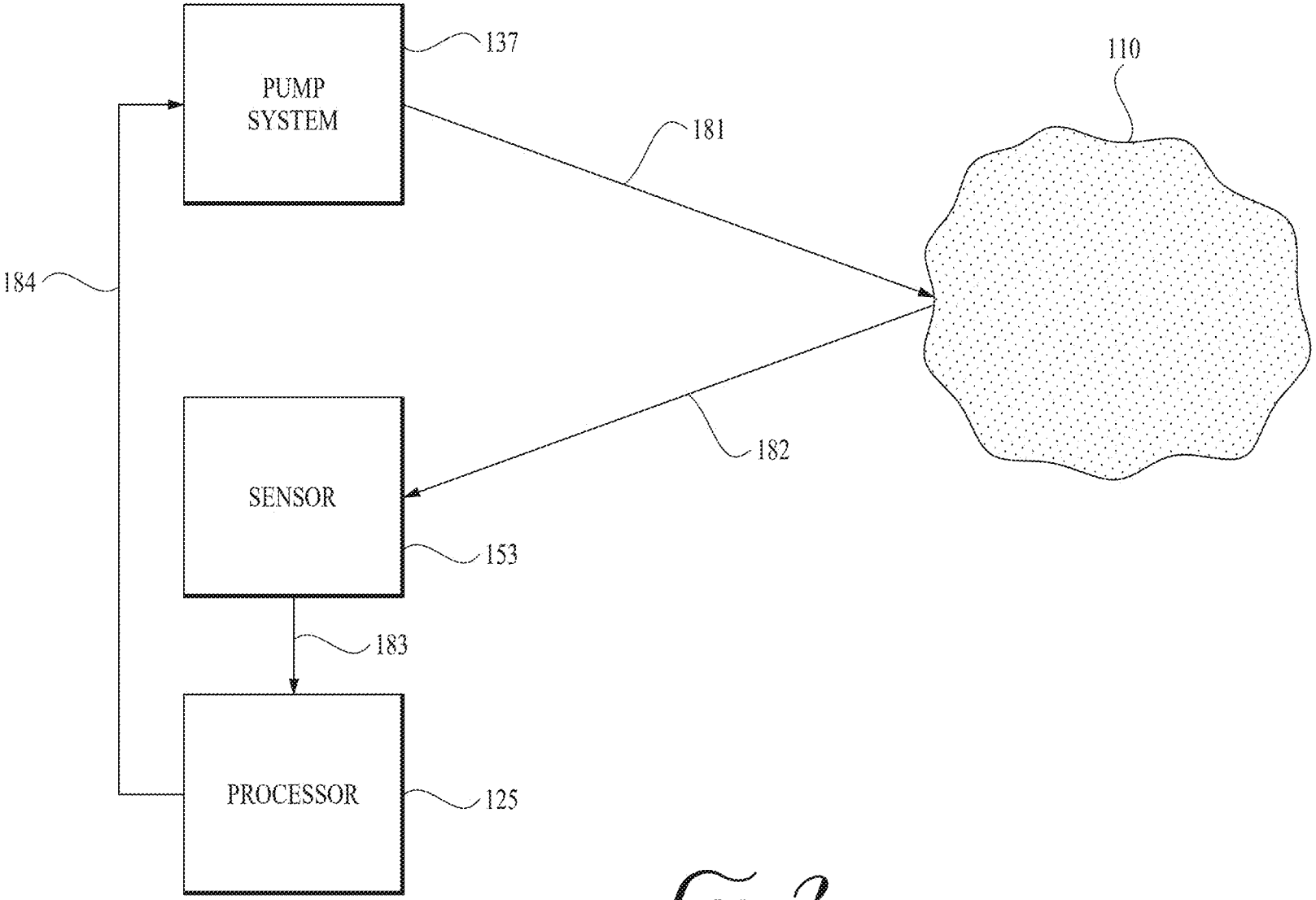
FIG. 3 is a schematic diagram of an exemplary control system, according to an embodiment.

Referring to FIG. 3, the pump system 137 may output a pressure signal 181 down the wellbore, the pressure signal 181 may interact with and/or be reflected by the formation 110, and the reflected pressure signal 182 may return up the wellbore and be detected by the sensor 153. The sensor 153 may send sensor data 183 to the processor 125, which may analyze the pressure signal and infer the state of the formation 110. For example, the processor 125 may predict a characteristic such as an extent of the fracture, a change in fracture length or size, permeability or change of permeability in the formation 110, and/or any other discernable characteristic of the formation 110. The processor 125 may send that characteristic information to a display where a technician may base a decision (e.g., regarding injection pressure or flow rate) on the characteristic information. For example, the technician may determine that the fracture is not large enough and decide to increase pressure or flow rate of the pump system 137. Or, the technician may see that the degree of fracturing is sufficient and halt the fracking operation (i.e., shut down the pumps). Alternatively, any of these processes may be automated by the processor 125. For example, the processor 125 may compare the fracturing characteristic to a threshold. In response to determining that the fracturing characteristic exceeds the threshold, the processor 125 may send a control signal 184 to the pump system 137 to halt the fracking operation (e.g., to shut down the pump and/or stop flow from the pump). In some embodiments, in response to determining that the fracturing characteristic falls below a threshold, the processor 125 may send a control signal 184 to the pump system 137 to increase pressure and/or flow rate (e.g., amplitude of the pressure signal and/or flow rate signal). The threshold may be a floating threshold that changes with time according to a fracking program.

In some embodiments, the processor 125 may determine cluster efficiency of the perforations 160 (e.g., what percentage of them are open) 110 based on the reflected pressure signal 182. The pump system 137 may be controlled based on the cluster efficiency. For example, the processor 125 may control the pump system 137 based on cluster efficiency values generated by a model. In some examples, a complexity factor and/or a proximity index may be determined by the processor 125. The processor 125 may control the pump system 137 based on the determined cluster efficiency, the determined complexity factor, the determined proximity index, and/or other factors.

Modulating the injection rate may be used to perform real-time pressure diagnostics regarding the wellbore 105. In some embodiments, amplitude, frequency, and/or combinations thereof of the injection rate may be varied, for example, according to an injection treatment plan, to modulate the flow rate of the pump system 137. With variability of the injection flow rate, a phase of an input function may be controlled relative to a phase of a response of the subterranean formation 110. In some embodiments, the input function to be controlled is the injection flow rate which has a given rate function that can be observed for a response in pressure.

Flow modulation may be used to create specific pressure profiles. Flow rate modulations may include starts and stops, pulses, and/or rapid changed in flowrate with respect to time (dQ/dt). Flow rate modulations may also be induced by driving pumping equipment (e.g., pump system 137) to a specified profile. Driven profiles may vary for each pumping unit. Sufficient electrical power supply may be required to accelerate electrically driven pumping units. Sharp inflections may require as much as 200-300% normally available power in order to perform quick flow rate changes. Sufficient power (either generated, supplied from the utility grid, or both) may be provided to enable the electrically driven pump 138 to change flow rates rapidly. This may require special preparation, as this may be different from typical operation where acceleration rates (i.e. ramp rates) are governed to be compatible with typical power supplies. As faster acceleration rates are desired to created higher amplitude pulse profiles, higher performance power supplies may be required to enable the rapid changes in pumping flow rate.

Pressure pulses can also be generated during shutdown of pumping units. Suddenly stopping flow into a wellbore may cause a pressure wave to propagate through the well. Engine-driven pumps can typically be stopped quickly, while electrically driven pumps can be more difficult to stop quickly without risk of damage to either electrical or mechanical components. Thus, it can be beneficial to use a combination of pumping units (e.g., one or more electrically driven pumps 138 and one or more engine driven pumps 139) depending on desired flow rate and pressure modulation profile. Total rate changes at the spread level may be created by specific timing of flow profiles between pumping units, causing them to intentionally be in- or out-of-phase, or varied to create beat-frequency-oscillations.

In some embodiments, one or more rate functions may be incorporated into an injection treatment plan monitored by the processor 125. The rate function may be the mode of rate of change or modulation. In some embodiments, the one or more rate functions may include changes in amplitude, frequency, and/or function of the change in rate. The change in function may be a near-instantaneous change in rate, a step function change in rate with a plurality of step changes, a linear function change over a time period, and/or a given mathematical function to increase or decrease flow rate over a time period. The injection rate may have a square rate function at an initial position. In some embodiments, the processor 125 (e.g., a computer subsystem) may actuate the pump system 137 to change the rate function to any other suitable rate function, such as a polynomial rate function or a linear rate function. In addition to varying the rate functions, the processor 125 (e.g., computer subsystem) may actuate the pump system 137 to vary the amplitude and/or frequency of the injection rate.

Figure 4A:
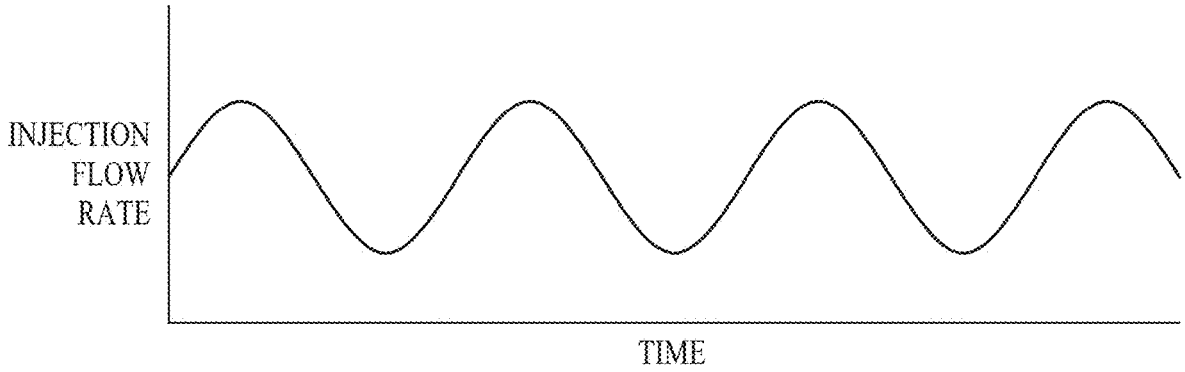
FIG. 4A is a graph of an exemplary injection flow rate, according to an embodiment.
Figure 4B:
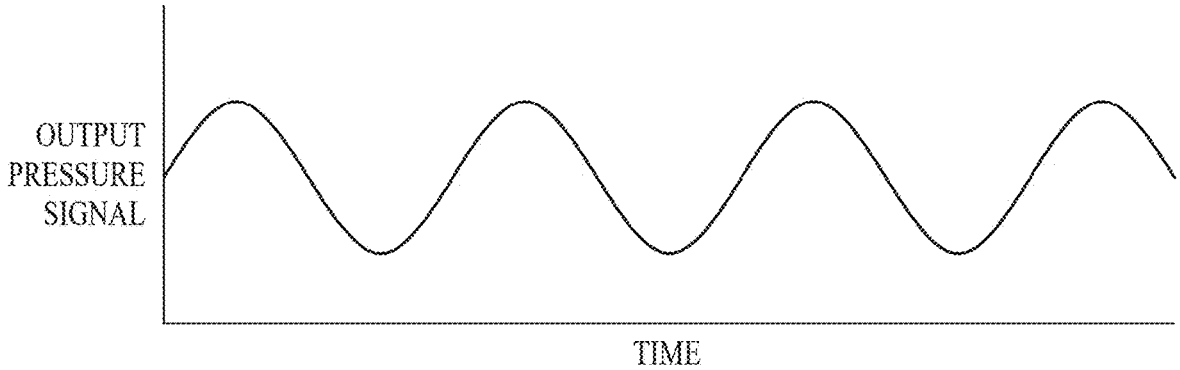
FIG. 4B is a graph of an exemplary output pressure signal, according to the embodiment of FIG. 4A.
Figure 4C:
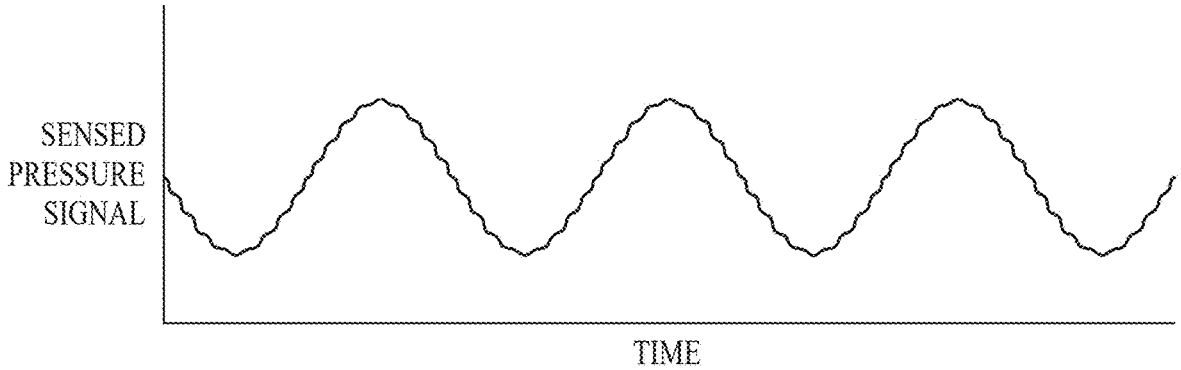
FIG. 4C is a graph of an exemplary sensed pressure signal, according to the embodiment of FIG. 4A.

FIG. 4A shows an exemplary output flow rate 180. The output flow rate may be generated by one or more electric pumps 137, flapper valves, and/or any other devices capable of modulating flow rate. FIG. 4B shows the output pressure signal 181 (as shown in FIG. 3) resulting from the modulated output flow rate 180. The output pressure signal 181 (i.e., pressure wave) may interact with the formation 110 and be reflected by it. FIG. 4C shows the reflected pressure signal 182 that is received by the sensor 183. In some embodiments, the output pressure wave 181 may be transient. For example, the output pressure wave may be last for a certain period of time and then be stopped but pumping may continue in steady state. That is, the output flow rate 180 may be oscillated and then the oscillations may stop such that the output flow rate 180 is constant. In some embodiments, the processor controls an oscillation of a flow rate of the pump to alternate between a first frequency and a second frequency, wherein the first frequency is below a natural frequency of the formation and the second frequency is above the natural frequency of the formation. In some embodiments, envelope of the oscillation increases over time. In some embodiments, an envelope of the oscillation decreases over time.

Figure 5A:
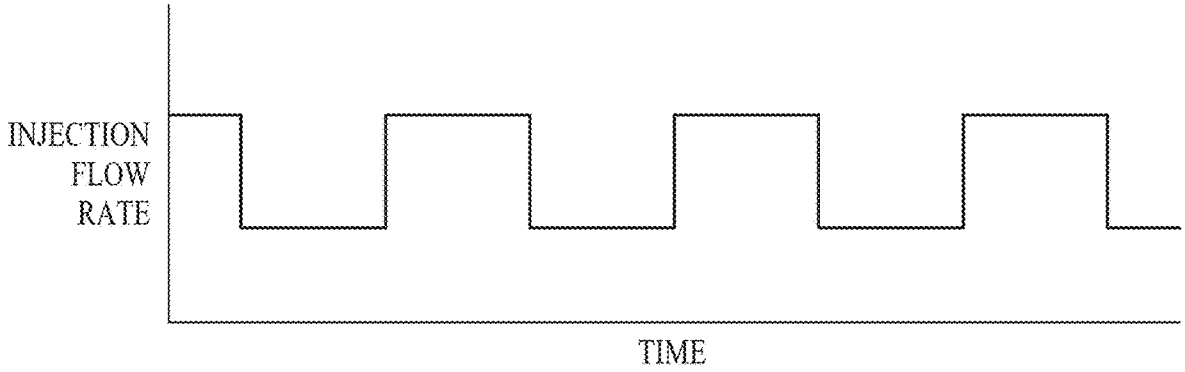
FIG. 5A is a graph of an exemplary injection flow rate according to another embodiment.
Figure 5B:
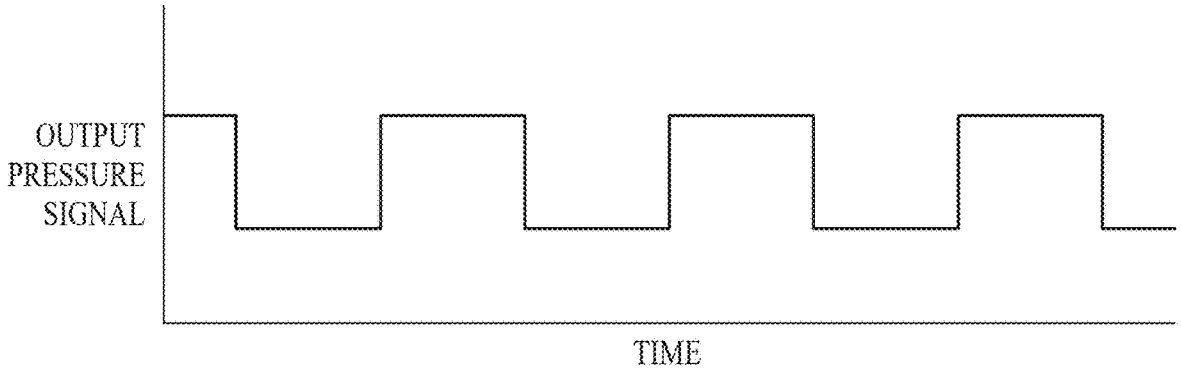
FIG. 5B is a graph of an exemplary output pressure signal according to the embodiment of FIG. 5A.
Figure 5C:
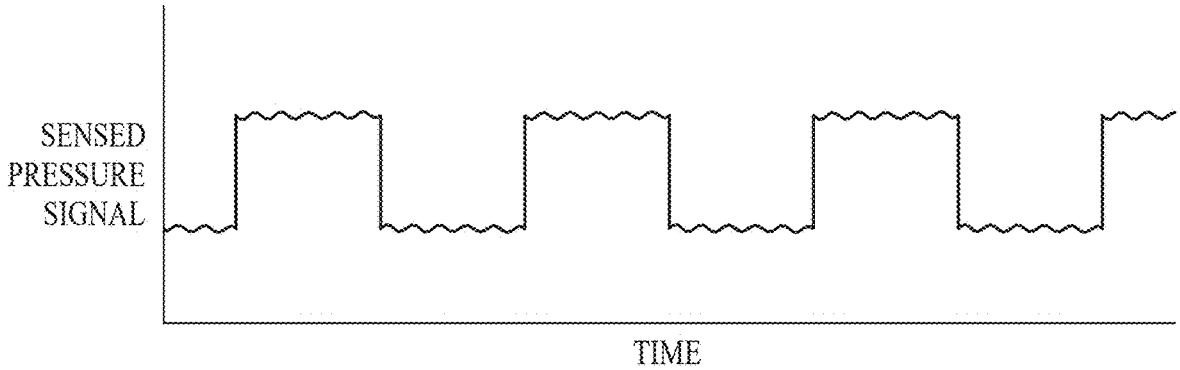
FIG. 5C is a graph of an exemplary sensed pressure signal according to the embodiment of FIG. 5A.

FIGS. 5A-5C are related to FIGS. 4A-4C except that instead of a sine wave the injection flow rate is a square wave. The rapid change in flow rate necessary to achieve a square wave or near square wave flow rate may be very difficult or impossible to achieve with conventional electric pumps. However, using a combination of electrically driven pumps 138 and engine driven pumps 139 as shown in FIG. 2 may enable such a flow rate to be achieved. The square wave may be particularly effective for making inferences about the state of the fracture based on a pressure response from the formation (e.g., the square wave being reflected off of the formation and detected by the sensor 153). In some embodiments, the processor 125 controls the electrically driven pump such that a flow rate change of the electrically driven pump causes a current consumption rate of change that is less than a maximum current rate of change the power supply is capable of providing, and controls the engine driven pump such that a flow rate change of the engine driven pump occurs concurrently with the flow rate change of the electrically driven pump.

Figure 7:
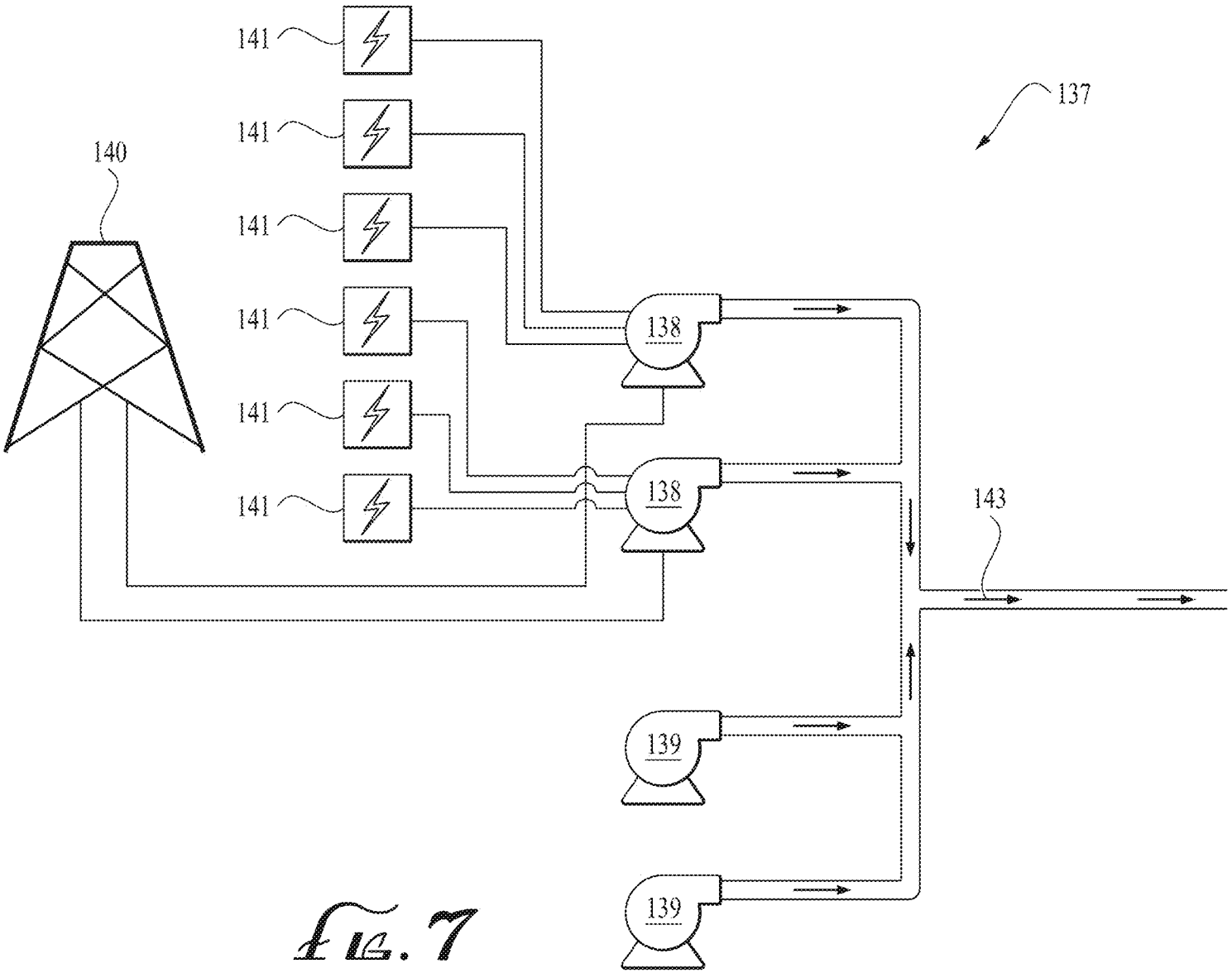
FIG. 7 is a schematic diagram of an exemplary pump system according to another embodiment.

FIG. 7 shows an exemplary configuration of pumps and power supplies. There may be electric driven pumps 138 and engine driven pumps 139 fluidly coupled in parallel. Each electric driven pump 138 may be connected to multiple generators 141 (e.g., gas turbine generators). Multiple generators 141 may be provided for supplying extra power during sharp increases in flow rates executed by the electric driven pump 138. In some embodiments, the electric driven pumps 138 are also connected to a power grid 140 (e.g., a power plant). In some embodiments, the power grid 140 supplies the electric power for constant flow rates or slowly changing flow rates of the electric driven pumps 138 and the generators 141 supply power only during sharp rises in energy demand when the electric driven pumps 138 sharply increase flow rate. In some embodiments, one generator 141 supplies electric power for each electric driven pump 138 for constant flow rates and gradually changing flow rates of the electric driven pumps 138, and one or more additional generators 141 and/or the power grid 140 supplies additional power to each electric driven pump 138 when the electric driven pumps 138 sharply increase their power consumption to achieve a sharp rise in flow rate.

Although the configuration shown in FIG. 7 includes two engine driven pumps 139, two electric driven pumps 138, six generators 141, and one electric power grid 140, any number of these elements may be present and/or one or more of these elements may be absent. For example, there may be 0, 1, 2, 3, 4, 5, 6, 7, 8, 9, 10 or more electric driven pumps 138; 0, 1, 2, 3, 4, 5, 6, 7, 8, 9, 10 or more engine driven pumps 139; and/or 0, 1, 2, 3, 4, 5, 6, 7, 8, 9, 10 or more generators 141 per electric driven pump 138. The electric driven pumps 138 may additionally or alternatively draw power from multiple power grids 140 and/or other power sources. The electric power plant 140 may have ramp rate limits (e.g., kilowatts per second). The processor 125 can instruct the electric driven pumps 138 to follow a flow-rate curve, e.g., provided that at any point along the curve the electric power supply has the capability to match the power level change per second (e.g., kilowatts per second) requirement without going outside of the bounds of voltage. For example, the steepest incline may be less than the maximum capability of the electric power grid 140 and/or the generators 141 (e.g., their stiffness). To achieve a very steep increase in flow rate, multiple power supplies may be combined in any suitable manner. In some embodiments, a clutch can be used to enable an abrupt reduction in flow rate in the electric pumps 138.

Using both electric driven pumps and engine driven pumps can be advantageous. Engine driven pumps can have the advantage in that they can be stopped rapidly without sustaining damage or causing power outages, but they may not capable of outputting complex pressure waveforms. On the other hand, electric driven pumps can more quickly and precisely adjust speed and may have a faster response time due to the direct control of electric current. The configuration of FIG. 7 can take advantage of both pumps' advantages while compensating for their disadvantages. For example, FIGS. 6A-6C shows an exemplary injection flow rate according to an embodiment that may be performed by the configuration of FIG. 7.

Figure 6A:
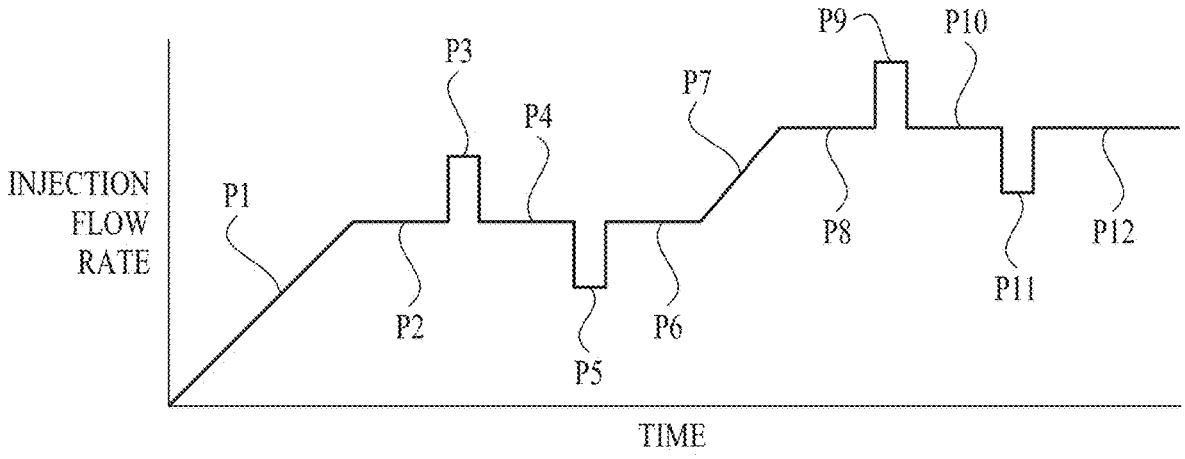
FIG. 6A is a graph of an exemplary injection flow rate according to yet another embodiment.

In FIG. 6A, a first phase P1 may involve ramping up flow rate output by the electric driven pumps 138 and the engine driven pumps 139 (e.g., from zero). Power may be gradually increased to the electric driven pumps 138 and the engine driven pumps 139 may be gradually throttled up. In a second phase P2, flow rate may be held constant (e.g., for half an hour or more). In a third phase P3, there may be a pulse. The pulse could be, for example, a square pulse in which flow rate is sharply increased for a brief period of time and then reduced to its previous level. To achieve the beginning of the pulse, the flow rate of the engine driven pumps 139 may be held constant and the flow rate of the electric driven pumps 138 may be rapidly increased by increasing a number of generators 141 supplying power to each of the electric driven pumps 138 and/or increasing a total amount of power supplied by the generators 141 and/or power supply. To achieve the end of the pulse, the flow rate of the engine driven pumps 139 may be sharply decreased (e.g., by disengaging a clutch). The flow rates of the electric driven pumps 138 may then gradually decrease and the flow rates of the engine driven pumps 139 may gradually increase to restore their previous flow rates before the pulse.

In the fourth phase P4, the flow rate may be held constant (e.g., at the same flow rate as in the second phase P2). In the fifth phase P5, there may be a pulse in which the flow rate is decreased sharply and then increases sharply to its previous level. To achieve the start of pulse in the fifth phase P5, the flow rate of the electric driven pumps 138 may be held constant while the flow rate of engine driven pumps 139 is sharply decreased. To achieve the end of the pulse of the fifth phase P5, the flow rate of the engine driven pumps 139 may be held constant while the flow rate of the electric driven pumps 138 may be sharply increased (e.g., by increasing the combined power provided by the generators 141/power supply and/or increasing the number of generators 141 providing power to each electric driven pump 138). The flow rate of the engine driven pumps 139 may then be gradually increased and the flow rate of the electric driven pumps 138 may be gradually decreased so that flow rates from the engine driven pumps 139 and electric driven pumps 138 are the same as before the pulse of the fifth phase P5. During the sixth phase P6, the flow rate output by the pumps 138,139 may be held constant (e.g., for half an hour or more).

Figure 6B:
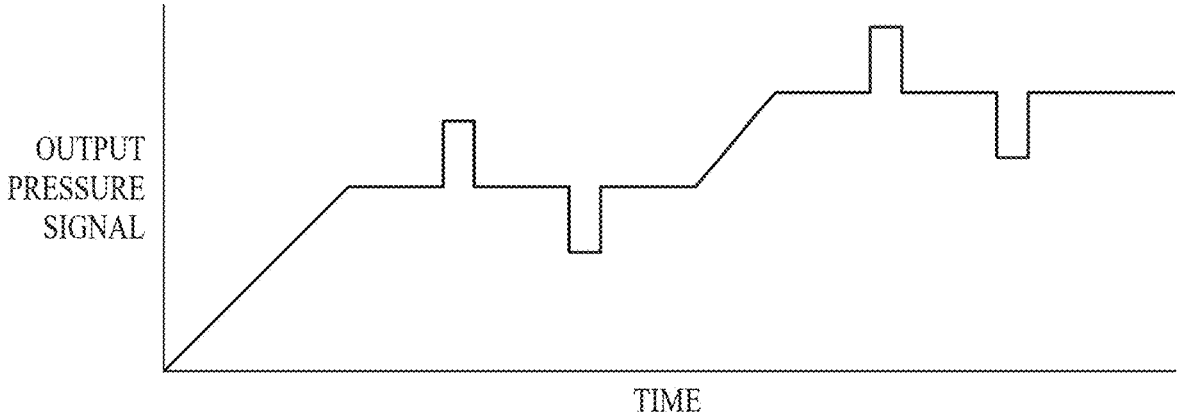
FIG. 6B is a graph of an exemplary output pressure signal according to the embodiment of FIG. 6A.
Figure 6C:
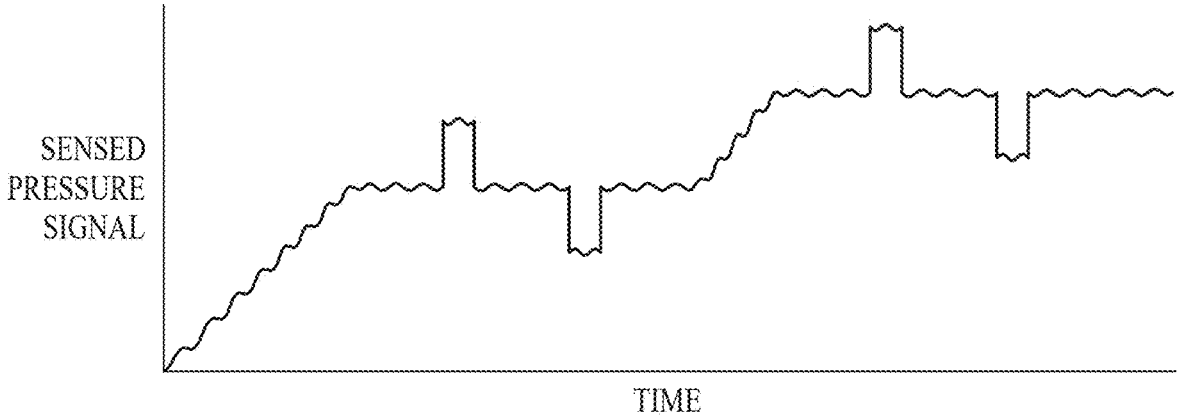
FIG. 6C is a graph of an exemplary sensed pressure signal according to the embodiment of FIG. 6A.

As can be seen in FIG. 6B, the pulses in injection flow rate may cause pulses in pressure as part of a pressure signal. As shown in FIG. 3, the output pressure signal 181 may be reflected off of the formation 110 and the reflected pressure signal 182 may be detected by the sensor 153. The sensor data 183 may be fed into a processor 125 that analyzes the sensor data 183. In response to the processor 125 determining, based on the sensor data 183, that fracking progress in the well is insufficient, a seventh phase P7 may be initiated in which injection flow rate is ramped up (e.g., the pumps 138,139 increase their flow rate gradually). Injection flow rate may then be held constant in the eighth phase P8. Phases P9, P10, P11, and P12 may then be initiated, which include pulses for again determining the state of the fracture. Phases P9, P10, P11, and P12 may be the same as phases P3, P4, P5, and P6, respectively, except that the pressures in the phases P9, P10, P11, and P12 are respectively higher than the pressures in the phases P3, P4, P5, and P6. After the pulses of phases P9 and P11 have been sent out as the output pressure signal 181, the processor 125 may assess the reflected pressure signal 182 to determine whether further adjustment to the injection flow rate is required.

The signals shown in FIGS. 6A-6C are an example of many possible signals. Any of the phases may be omitted and/or additional phases may be added. In addition, the pulses may be added on a carrier wave. In some embodiments, the pulses are on top of an oscillation at or near a natural frequency of the formation. Flow rate, and thus pressure modulations may be driven at low frequencies with long periods and/or may be driven repeatedly over long durations. Oscillation period can be, for example, several minutes and/or have durations of several hours. In some embodiments, the oscillation period may be 10 seconds, 30 seconds, 1 minute, 2 minutes, 3 minutes, or more. In some embodiments, duration may be 10 minutes, 30 minutes, 1 hour, 2 hours, 3 hours, or more. Electrically driven pumping units are especially well-suited for this type of modulation.

Pressure waves may be attenuated as they travel down the wellbore, and thus the desired downhole waveform may require a different initial waveform on the surface. Surface waveforms may also be modulated by changing parameters such as amplitude, frequency, phase-shift, rate-of-change flow, waveform shape, duration, period, etc. Such surface modulation may be implemented to cause downhole waveforms to "sweep" through a shape or area of interest. Flow rates can be controlled dynamically to achieve a particular downhole target pressure, dynamic downhole pressure, and/or a rate profile in coordination with particulate and/or chemical concentrations in a pumped treatment fluid to achieve arrival at particular locations in the formation, such as along a network of fractures. Multiple waves and their reflected forms may also be used to collide at areas of interest in the wellbore. Rate modulation may be used to target specific well depths for potential wave interference from reflected waves and pumping waves to create high magnitude pressure pulses within the wellbore. The frequencies may be varied to target different depths that may correspond to different perforated intervals.

Multiple waveforms may also be additive to create more complex forms. For example, a sinusoidal wave may ride on a longer period square wave. Different pumps may output different flow rate or pressure waveforms that are additive to achieve the desired injection flow rate or injection pressure waveform. Pressure modulations may be created to remain in certain regimes relative to wellbore and formation parameters, such as staying consistently about a fracture-propagation threshold, intentionally going above and/or below fracture-propagation threshold, and/or spanning fracture closure pressure of primary or secondary fractures. Selection of parameter ranges can help enable diagnostics across a length of wellbore and formation characteristics. Such modulation may also assist fracture growth and complexity by fatiguing the formation, resulting in improved stimulation, fluid and proppant placement, and greater Stimulated Reservoir Volume (SRV). In some embodiments, the oscillations comprise accelerating undulations. In some embodiments, the oscillations comprise decelerating undulations. In some embodiments, the oscillations have an increasing envelope. In some embodiments, the oscillations have a decreasing envelope. In some embodiments, the oscillation can be a decelerating undulation to continuously match the natural frequency of the formation as it decreases. As the fracturing progresses, the natural frequency of the formation tends to decrease. In some embodiments, the oscillations last two hours, three hours, or more. The natural frequency of the formation may be the natural frequency of the formation surrounding the wellbore and also the wellbore itself.

Any shape of wave is within the scope of the present disclosure. For example, the wave may be a square wave (e.g., a non-sinusoidal periodic waveform represented by a combination of various waveforms (e.g., an infinite summation of sinusoidal waves) having an amplitude that alternates at a steady frequency between fixed minimum and fixed maximum values and a fixed duration at the minimum and maximum altitude values (i.e., forming square wave shapes)). The wave may be a sawtooth wave (e.g., a non-sinusoidal periodic waveform having sharp slanted ramps upward and sharp drops, or sharp slanted ramps downward and sharp drops). The wave may be a triangle wave (e.g., a non-sinusoidal periodic waveform having sharp slanted ramps upward and sharp slanted ramps downward, or sharp slanted ramps downward and sharp slanted ramps upward (i.e., forming triangle wave shapes)). The wave may be a rectangle wave (e.g., a non-sinusoidal periodic waveform having an amplitude that alternates at a steady frequency between fixed minimum and fixed maximum values, but a varying duration at the minimum and maximum altitude values (i.e., forming rectangle wave shapes)). The wave may have an irregular waveform of any amplitude, duration, and periodicity. The wave may be a combination of existing waveshapes.

In some embodiments, pressure waves may be generated additionally or alternatively by changing flow restrictions. Devices such as valves and chokes may be used to alter fluid flow into or out of the wellbore. A choke setting may be changed suddenly to increase or decrease fluid entering or exiting the wellbore 105 which may create a pressure wave. Multiple fluids can also be used to induce a pressure change, for instance, loading a wellbore with a gaseous material with liquid below, then flowing the well back through a restriction. As the gas flows through a given restriction such as a choke, orifice, or other such restriction, a given pressure will be generated. Then, when the liquid gets to the same flow restriction, pressure may spike due to the change thus creating a significant pulse (e.g., a "water-hammer"). Pumping equipment may be engine-driven or driven with electric motors. Engine driven equipment can be fueled with gaseous or liquid fuels such as diesel, gasoline, kerosene, Compressed Natural Gas (CNG), Liquified Natural Gas (LNG), conditioned field gas, hydrogen, or combinations thereof.

Hydraulic fracturing may be most effective when the pressure wave output by the pumps matches the natural frequency of the formation (e.g., the wellbore and the formation surrounding the wellbore). Feedback from the well can help determine if the oscillation is staying in sync with the natural frequency of the fracture formation and adjustments can be made if necessary (e.g., automated by the processor). For example, if it is detected that the natural frequency of the formation has been reduced, the frequency of the oscillation can be set to match the reduced natural frequency. In some embodiments, sweeps are done between frequencies above and below the estimated natural frequencies of the well. For example, the pumps may be controlled to start the oscillation at a frequency at below the estimated natural frequency of the formation and then slowly ramp of the frequency of the oscillation to above the estimated natural frequency of the formation. The natural frequency could have, for example, a period of thirty seconds. Matching the natural frequency can enhance the complexity of the fracture, fatigue the formation, and/or create secondary fractures. For any embodiment involving a pulse, a wave can be used alternatively or additionally. For any embodiment involving a wave, a pulse can be used alternatively or additionally.

Figure 8A:
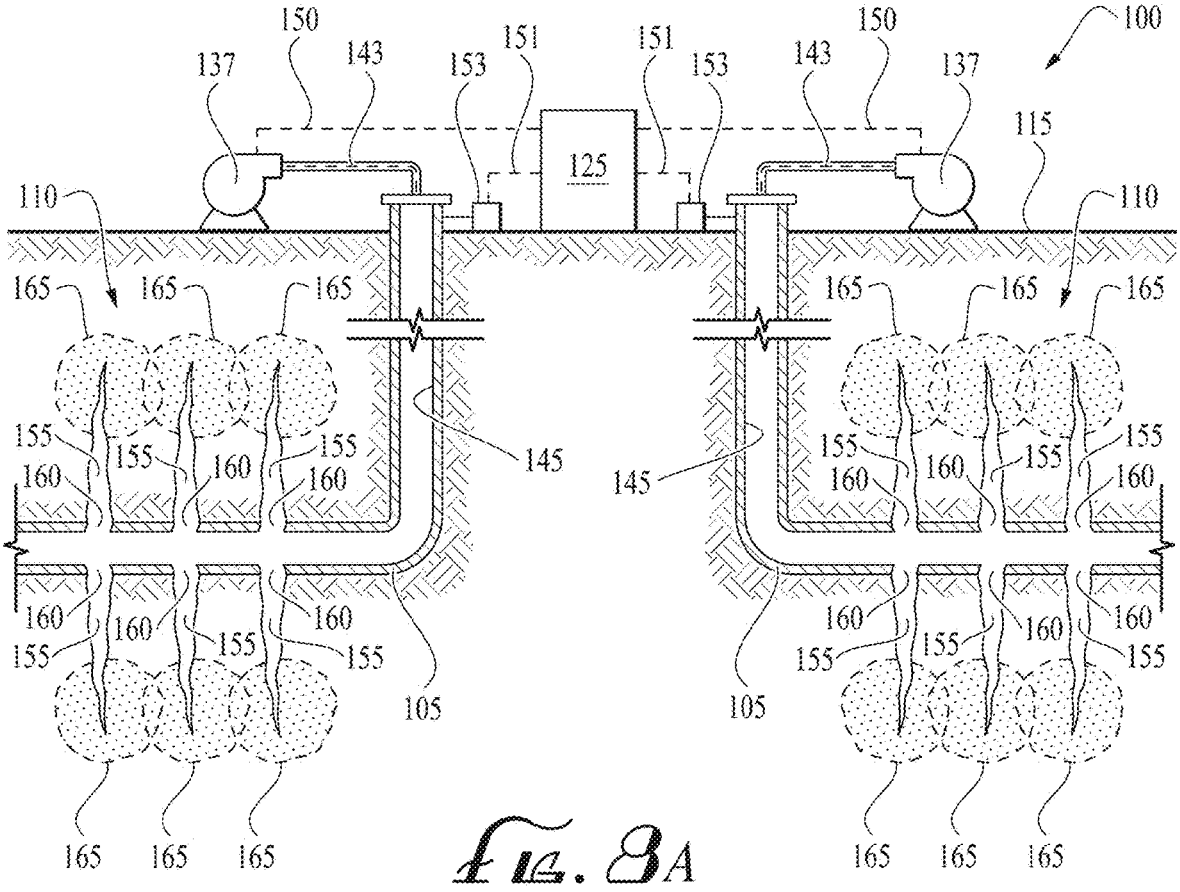
FIG. 8A is a schematic diagram of an exemplary well system according to another embodiment.
Figure 8B:
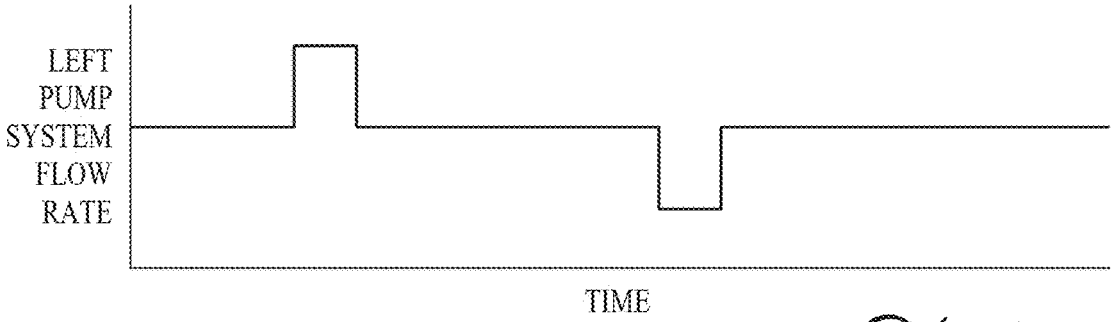
FIG. 8B is a graph of an exemplary injection flow rate of the left pump of FIG. 8A.
Figure 8C:
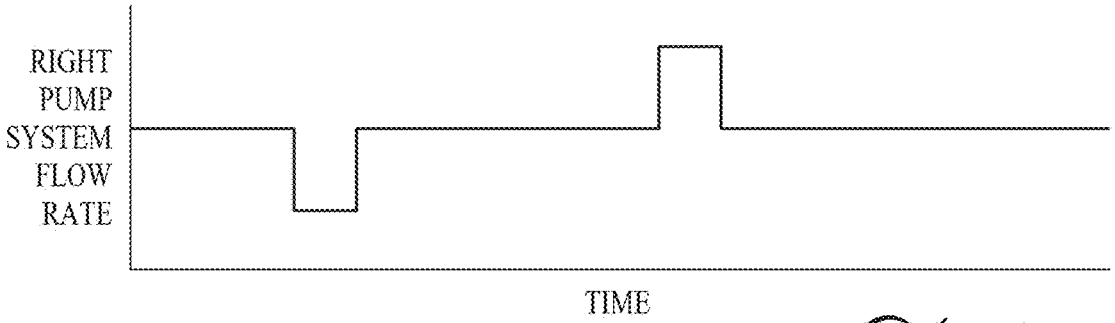
FIG. 8C is a graph of an exemplary injection flow rate of the right pump of FIG. 8A.

Referring to FIG. 8, a simultaneous fracking operation in a well system 100 is shown. The configuration may be similar to that of FIG. 1 except there are two wellbores 105 and two pump systems 137, one for each wellbore 105. In some embodiments, there are multiple pump systems 137 fluidly coupled to each wellbore. The pump system 137 could take the form shown in FIG. 2, the form shown in FIG. 7, or any other suitable configuration. The pump system 137 may be controlled by the processor 125. Each pump system 137 may draw power from a common power generation system (e.g., generators and/or a power grid). As shown in FIG. 8B, the processor 125 may control the pump systems 137 such that as the left pump system 137 executes a positive pulse (e.g., in flow rate and/or pressure) and concurrently the right pump system 137 executes a negative pulse. As shown in FIG. 8C, at another instant in time, as the left pump system 137 may execute a negative pulse the left pump system 137 may execute a positive pulse. This may balance the change in power demand from the pump pulsing to the positive with a decrease in power demand from the pump pulsing to the negative. This principle is not limited to pulses. Any abrupt change in the flow rate of one of the pumps systems 137 may be mirrored in the negative by the flow rate of another of the pump systems 137. For example, the left pump and the right pump could output waveforms (e.g., sine waves) phase shifted with respect to each other such that the sum of the waveforms is zero at all points. In another example, each pump may output a pressure signal individually exceeding the stiffness of the power supply but when the signals are added the stiffness of the power supply is not exceeded. Thus, the configuration of FIG. 8A may avoid the need for engine driven electric pumps and/or power sources with enhanced stiffness for the pump systems 137.

Figure 9:
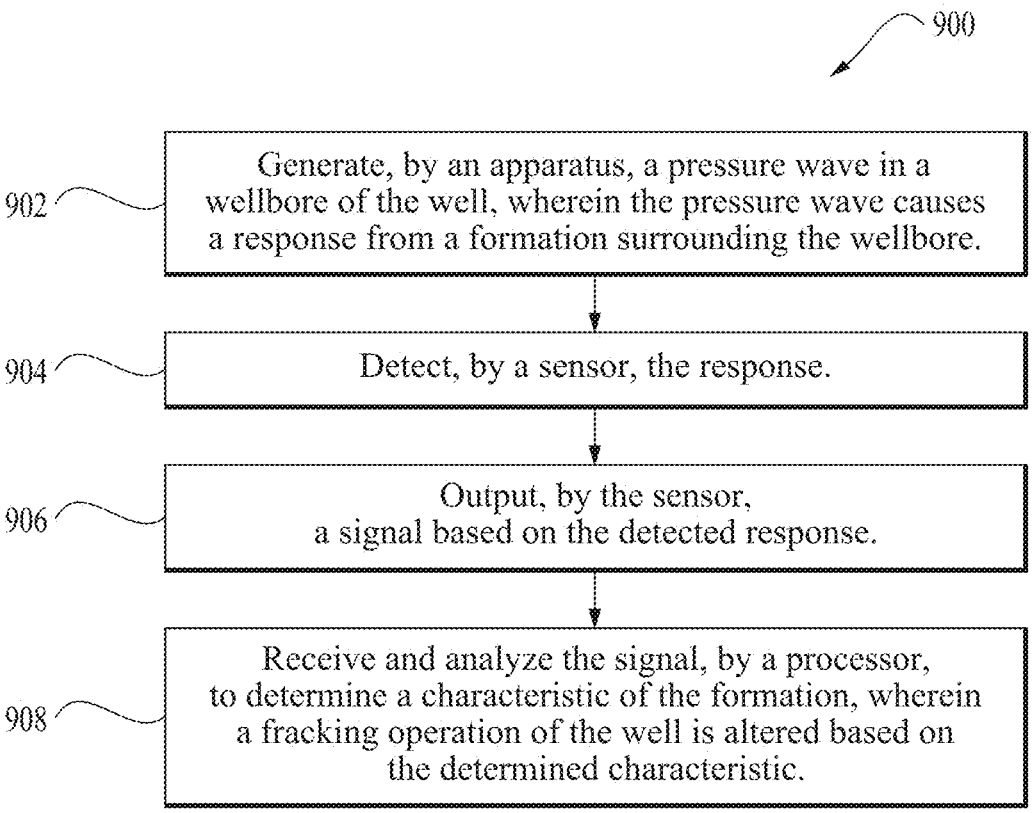
FIG. 9 is a flow diagram of an exemplary method for monitoring hydraulic fracturing of a well.

Referring to FIG. 9, an exemplary method 900 of monitoring hydraulic fracturing of a well is shown. The method 900 may include the step 902 of generating, by an apparatus, a pressure wave in a wellbore of the well, wherein the pressure wave causes a response from a formation surrounding the wellbore. The method 900 may further include the step 904 of detecting, by a sensor, the response. The method 900 may further include the step 906 of outputting, by the sensor, a signal based on the detected response. The method 900 may further include the step 908 of receiving and analyzing the signal, by a processor, to determine a characteristic of the formation, wherein a fracking operation of the well is altered based on the determined characteristic. This method 900 may present the advantage of enhancing the effectiveness of fracking by gaining information about the state of the fracture and taking appropriate action.

Figure 10:
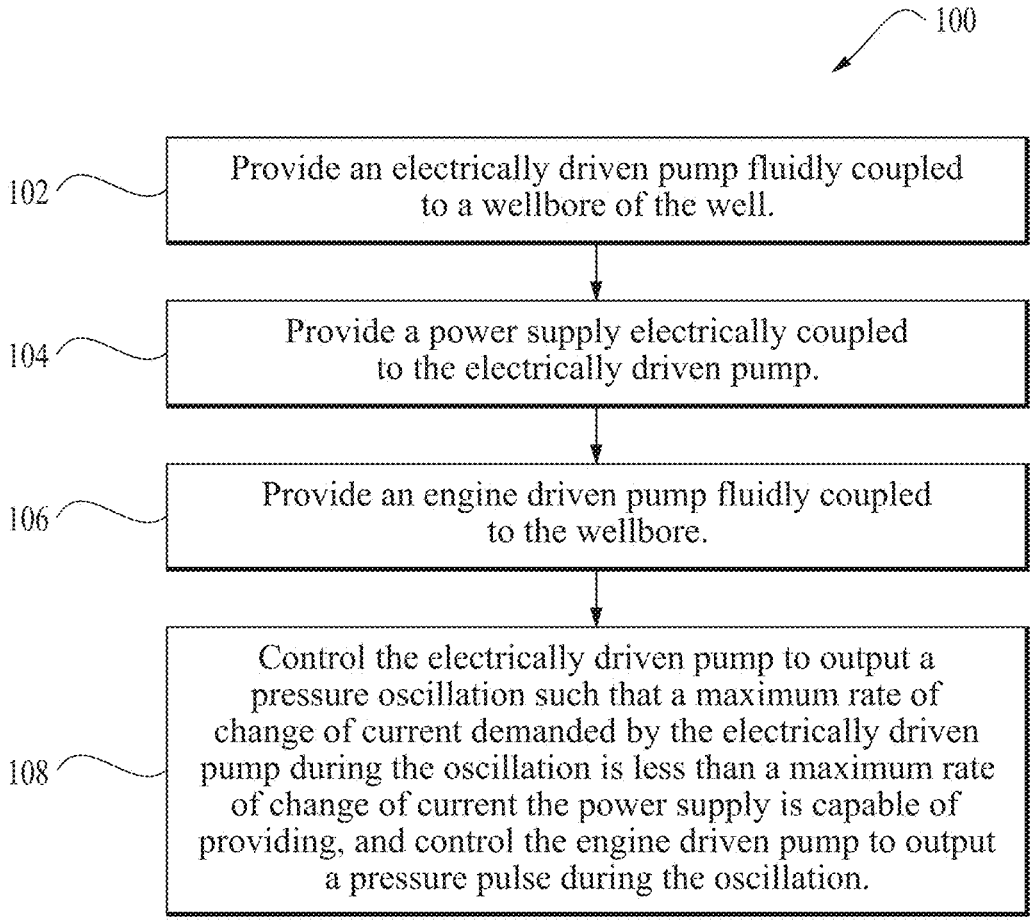
FIG. 10 is a flow diagram of an exemplary method for sending a diagnostic pressure signal into a well.

Referring to FIG. 10, an exemplary method 100 of sending a diagnostic pressure signal into a well is shown. The method 100 may include the step 102 of providing an electrically driven pump fluidly coupled to a wellbore of the well. The method 100 may further include the step 104 of providing a power supply electrically coupled to the electrically driven pump. The method 100 may further include the step 106 of providing an engine driven pump fluidly coupled to the wellbore. The method 100 may further include the step 108 of controlling the electrically driven pump to output a pressure oscillation such that a maximum rate of change of current demanded/consumed by the electrically driven pump during the oscillation is less than a maximum rate of change of current the power supply is capable of providing, and controlling the engine driven pump to output a pressure pulse during the oscillation. The pressure pulse executed by the engine driven pump may be steeper than the electric driven pump could execute without exceeding the stiffness of the power supply. Thus, this method may enable simultaneous diagnostic of the formation via the pulse and fracturing of the formation via the oscillation.

Figure 12A:
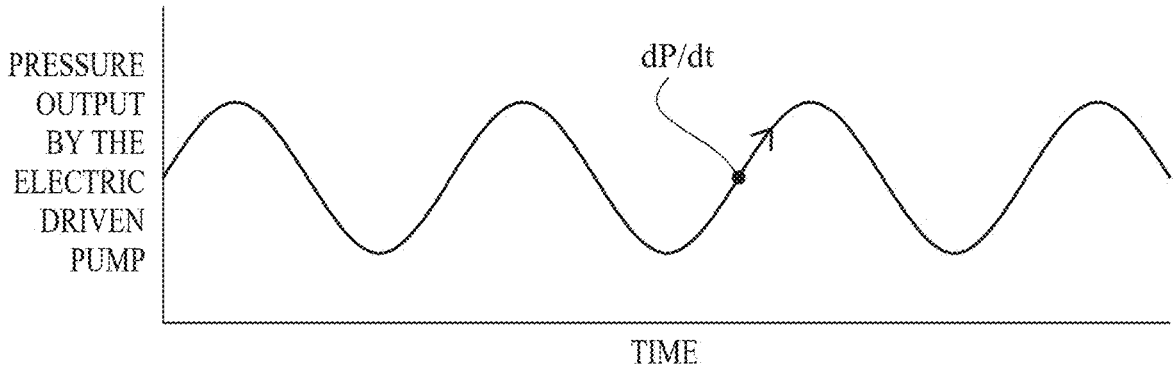
FIG. 12A is a graph of pressure output by the electric driven pump, according to an embodiment.
Figure 12B:
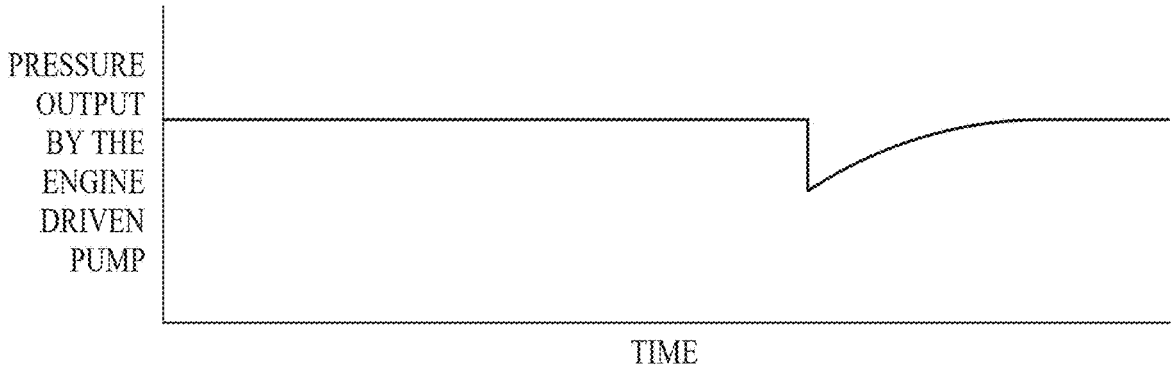
FIG. 12B is a graph of pressure output by the engine driven pump, according to an embodiment.
Figure 12C:
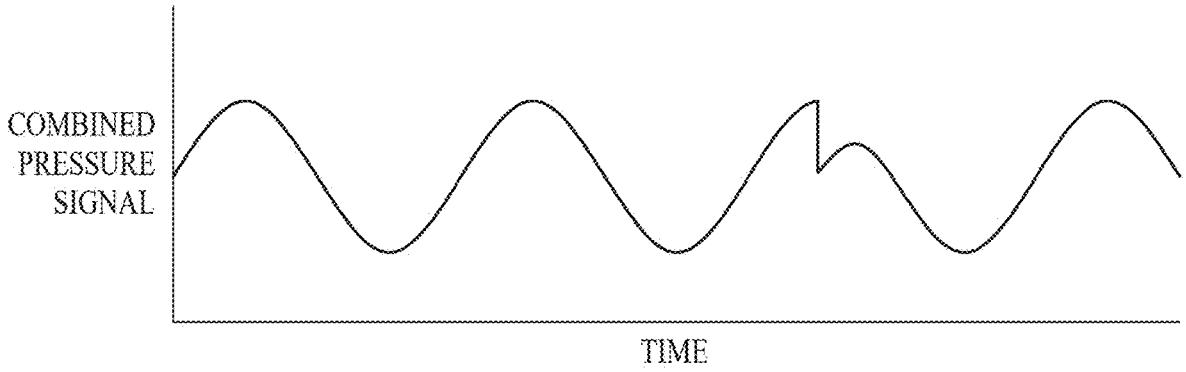
FIG. 12C is a graph of a combined pressure signal of the electric driven pump of FIG. 12A and the engine driven pump of FIG. 12B.

FIGS. 12A-12C illustrate an example of the implementation of the method of FIG. 10. In FIG. 12A, the pressure output by the electric driven pump is shown. In FIG. 12A, the pressure oscillations are shown as a sine wave, but any waveform is within the scope of the present disclosure. The graph is labeled dP/dt at a point in time at which the change in pressure (e.g., pressure change per time) is at maximum. This may also be the point in time at which the rate of change of flow rate (e.g., change in flow rate per time dQ/dt) is at maximum. This may also be the point in time at which the rate of change in electrical current demanded by the electric driven pump is at maximum. The controller may control the oscillation such that dP/dt and/or dQ/dt does not cause a demand of a rate of change in the electrical current (e.g., change in current per time) that exceeds the capability (e.g., stiffness) of the power source (e.g., power grid and/or generators). FIG. 12B shows the pressure output by the engine driven pump having a downward spike during the oscillation of the pressure output by the electric driven pump which is shown in FIG. 12A. In this example, the downward spike in FIG. 12B may be accomplished by rapidly stopping or slowing down the engine driven pump and then more slowly increasing (e.g., ramping up) the flow rate of the engine driven pump. In some embodiments, the pulse is caused by various other methods (e.g., by a flapper valve or modulating pump valves). Because the electric driven pump and the engine driven pump may be both fluidly coupled to the wellbore of the well, the pressure signal of the electric driven pump and the pressure signal of the engine driven pump may be additive to yield the combined pressure signal. In this example, the combined pressure signal feature oscillations designed to fracture the formation and a pulse designed to be reflected by the formation, detected by a sensor upon reflection, and analyzed to determine a state of the fracturing of the formation. The determined state of fracturing of the formation can then be used to adjust the frequency and/or amplitude of the oscillation and/or adjust another operation related to the fracking.

Figure 11:
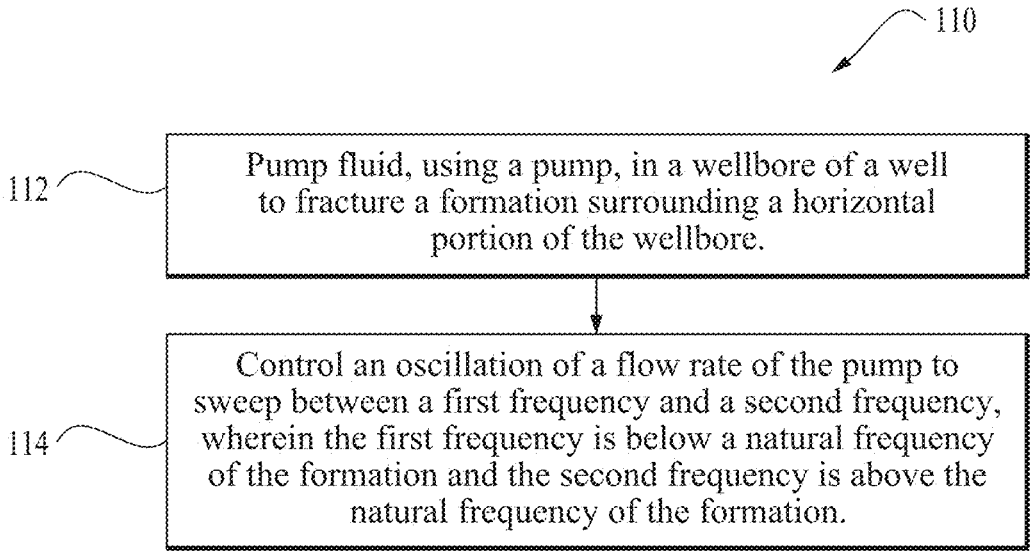
FIG. 11 is a flow diagram of an exemplary method for hydraulic fracturing.

Referring to FIG. 11, an exemplary method 110 of hydraulic fracturing is shown. The method 110 may include the step 112 of pumping fluid, using a pump, in a wellbore of a well to fracture a formation surrounding a horizontal portion of the wellbore. The method 110 may further include the step 114 of controlling an oscillation of a flow rate of the pump to sweep or alternate between a first frequency and a second frequency, wherein the first frequency is below a natural frequency of the formation and the second frequency is above the natural frequency of the formation. The oscillation between the first frequency and the second frequency may be gradual so that there is a high likelihood that the natural frequency of the formation will be covered by this sweep. This may enhance fracturing effectiveness. In some embodiments, the transition from the first frequency to the second frequency may be done continuously over thirty minutes or more; and the transition from the second frequency to the first frequency may be done continuously over thirty minutes or more. In some embodiments, the oscillation may be a sine wave and the pulse may be a square wave. Sweeping between the first frequency and the second frequency may ensure that the natural frequency of the formation is attained at least for part of the fracking duration.

Figure 13A:
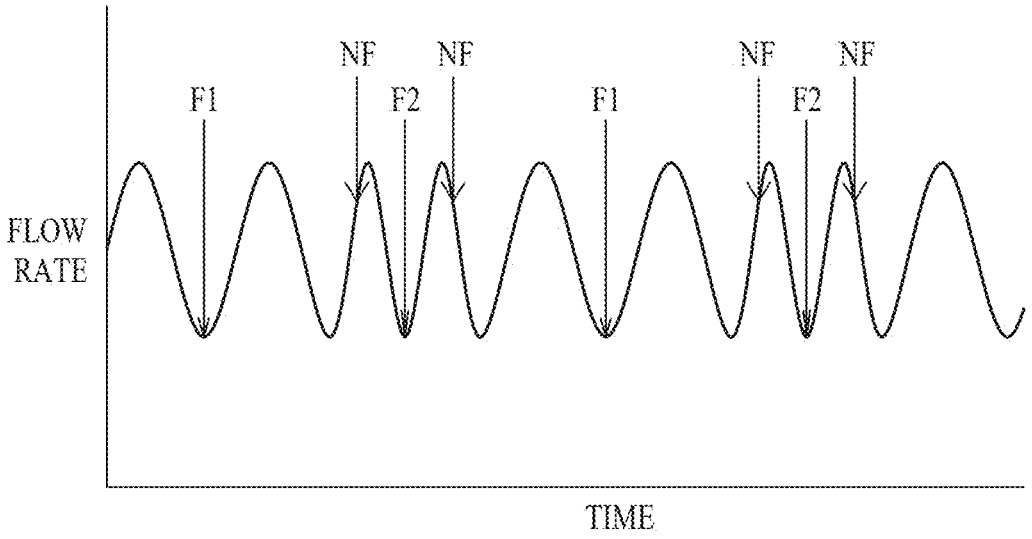
FIG. 13A is a graph conceptually illustrating the oscillation of flow rate, according to an embodiment.
Figure 13B:
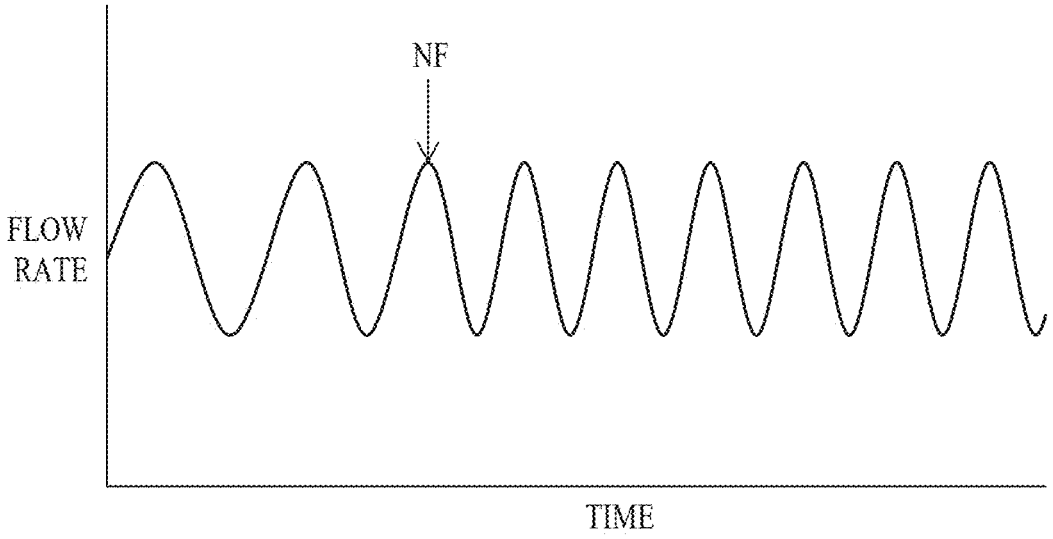
FIG. 13B is a graph conceptually illustrating an adjustment of the oscillation of flow rate to match the natural frequency of the formation, according to an embodiment.

FIGS. 13A-13B illustrate an example implementation of the method of FIG. 11. It should be apparent that graph of FIG. 13 is only for conceptual illustration and is not to scale. As shown in FIG. 13A, the electrically driven pump may output a flow rate that oscillates. The oscillation may sweep (in this example, alternate) between a first frequency F1 and a second frequency F2. That is, the frequency of the oscillation (in this example, a sine wave) may change over time. The first frequency may be below a natural frequency NF of the formation and the second frequency may be above the natural frequency NF of the formation. During the sweep, the natural frequency may be reached at various points. This may be advantageous because it may promote fracturing of the formation. In the example of FIG. 13B, pressure waves may be output at a certain frequency and may be reflected off of the formation and may be analyzed by a processor (e.g., using the method discussed with relation to FIG. 3). The pressure waves may be increasing in frequency, decreasing in frequency, part of an alternation, part of a sweep, or any other suitable wave. Once the natural frequency of the formation is estimated, the flow rate oscillations may be adjusted to have a frequency that matches (e.g., is the same as) the estimated natural frequency NF of the formation. In this example, the estimated natural frequency is matched at the point in time indicated by NF, and then the pump continues to output that natural frequency (e.g., frequency in terms of flow rate). In some embodiments, this is an iterative process in which the natural frequency is estimated multiple times and followed by an adjustment if necessary. In some embodiments, the frequency of the oscillations is set at the estimated natural frequency and then increased or decreased according to a predicted increase or decrease in natural frequency of the formation. Matching the frequency of the formation may enhance fracking effectiveness.

The systems and methods disclosed herein may provide the advantage of being able to effectively fracture and diagnose the fracture. In some embodiments, this is advantageously performed simultaneously; feedback about the degree of the fracture is continuously or periodically received and is used to determine how to adjust the method of hydraulic fracturing. The systems and methods disclosed herein may also provide the advantage of being able to execute complex waveforms with sudden changes (e.g., pulses for diagnostics) without overloading the power supply. The systems and methods disclosed herein may also provide the advantage of being able to more effectively fracture a formation as compared with the conventional art by using a sweeping pressure waveform about a natural frequency of the formation.

Additional Disclosure

The following are non-limiting, specific embodiments in accordance with the present disclosure:

In a first embodiment, a system for monitoring hydraulic fracturing of a well includes an apparatus configured to generate a pressure wave in a wellbore of the well, wherein the pressure wave causes a response from a formation surrounding the wellbore; a sensor configured to detect the response, and output a signal based on the detected response; and a processor configured to receive the signal, and analyze the signal to determine a characteristic of the formation, wherein a fracking operation of the well is altered based on the determined characteristic.

A second embodiment can include the system of the first embodiment, wherein the pressure wave is a pulse.

A third embodiment can include the system of the first or second embodiments, wherein the response is a pressure response that propagates through fluid in the wellbore.

A fourth embodiment can include the system of any of the first through third embodiments, wherein the pressure response is caused by the pressure wave reflecting off of the formation.

A fifth embodiment can include the system of any of the first through fourth embodiments, wherein the apparatus comprises an electrical power generator, a pump, a blender, a manifold, a flow-pulsing device, or a flow control device.

A sixth embodiment can include the system of any of the first through fifth embodiments, wherein the apparatus comprises an electrically driven pump, and the pressure wave is generated by modulating a flow rate output by the electrically driven pump.

A seventh embodiment can include the system of any of the first through sixth embodiments, wherein each electrically driven pump is electrically coupled to a plurality of generators (e.g., a first electrically pump is connected to a first, second, and third generator, and a second electrically driven pump is connected to a fourth, fifth, and sixth generator.

A seventh embodiment can include the system of any of the first through sixth embodiments, wherein the apparatus comprises an engine driven pump, and the pressure wave is generated by modulating a flow rate output by the engine driven pump.

An eight embodiment can include the system of any of the first through seventh embodiments, wherein the apparatus comprises an engine driven pump disposed at a surface of the well and an electric driven pump disposed at the surface of the well, and wherein a combined output of the engine driven pump and the electric driven pump forms the pressure wave.

A ninth embodiment can include the system of any of the first through eighth embodiments, wherein the pressure wave is at a natural frequency of the formation.

A tenth embodiment can include the system of any of the first through ninth embodiments, wherein the pressure wave is generated by modulating amplitude, frequency, phase-shift, rate-of-change flow, wave form shape, duration, or period.

An eleventh embodiment can include the system of any of the first through tenth embodiments, wherein the apparatus is disposed at a surface of the well, the formation is disposed proximate to a horizontal portion of the wellbore, and the apparatus is configured to fracture the formation.

A twelfth embodiment can include the system of any of the first through eleventh embodiments, wherein the processor is further configured to analyze the signal by comparing the signal to a model, and control a rate at which the apparatus injects fluid into the well based on a result of the comparison.

A thirteenth embodiment can include the system of any of the first through twelfth embodiments, wherein the characteristic is a degree of fracturing of the formation.

A fourteenth embodiment can include the system of any of the first through thirteenth embodiments, wherein the apparatus comprises an electrically driven pump and an engine driven pump, and the processor is further configured to control the electrically driven pump such that a flow rate change of the electrically driven pump causes a current consumption rate of change that is less than a maximum current rate of change the power supply is capable of providing, and control the engine driven pump such that a flow rate change of the engine driven pump occurs concurrently with the flow rate change of the electrically driven pump.

In a fifteenth embodiment, a system for sending a diagnostic pressure signal into a well comprises an electrically driven pump fluidly coupled to a wellbore of the well; a power supply electrically coupled to the electrically driven pump; an engine driven pump fluidly coupled to the wellbore; and a processor configured to control the electrically driven pump such that a flow rate change of the electrically driven pump causes a current consumption rate of change that is less than a maximum current rate of change the power supply is capable of providing, and control the engine driven pump such that a flow rate change of the engine driven pump occurs concurrently with the flow rate change of the electrically driven pump, or alternatively, the processor is configured to control the electrically driven pump to output a pressure oscillation such that a maximum rate of change of current demanded/consumed by the electrically driven pump during the oscillation is less than a maximum rate of change of current the power supply is capable of providing, and control the engine driven pump to output a pressure pulse during the oscillation A sixteenth embodiment can include the system of the fifteenth embodiment, wherein the power supply comprises a gas turbine generator.

A seventeenth embodiment can include the system of the fifteenth or sixteenth embodiments, wherein the power supply comprises a power grid.

An eighteenth embodiment can include the system of any of the fifteenth through seventeenth embodiments, wherein the flow rate change of the electrically driven pump is a flow rate increase of the electrically driven pump, the flow rate change of the engine driven pump is a flow rate increase of the engine driven pump, and the current rate of change is a current increase per time.

A nineteenth embodiment can include the system of any of the fifteenth through eighteenth embodiments, wherein the flow rate change of the electrically driven pump is a flow rate decrease of the electrically driven pump, and the flow rate change of the engine driven pump is a flow rate decrease of the engine driven pump, and the current rate of change is a current decrease per time.

A twentieth embodiment can include the system of any of the fifteenth through nineteenth embodiments, wherein the decrease in flow rate of the engine driven pump is caused by a decoupling (e.g. shifting transmission to neutral) of the engine driven pump.

A twenty-first embodiment can include the system of any of the fifteen through twentieth embodiments, wherein the maximum current rate of change is a maximum current rate of change that the power supply is capable of providing without a voltage sag beyond a specified tolerable limit.

A twenty-second embodiment can include the system of any of the fifteenth through twenty-first embodiments, wherein the maximum current rate of change is a maximum current rate of change that the power supply is capable of tolerating without an overvoltage.

A twenty-third embodiment can include the system of any of the fifteenth through twenty-second embodiments, wherein the maximum current rate of change is a maximum current rate of change that the power supply is capable of providing without causing a brown out of the power supply.

A twenty-fourth embodiment can include the system of any of the fifteenth through twenty-third embodiments, wherein the maximum current rate of change is a maximum current rate of change that the power supply is capable of providing without causing a black out of the power supply.

A twenty-fifth embodiment can include the system of any of the fifteenth through twenty-fourth embodiments, wherein the flow rate change of the electrically driven pump and the flow rate change of the engine driven pump generates a pressure wave in the wellbore.

A twenty-sixth embodiment can include the system of any of the fifteenth through twenty-fifth embodiments, wherein the pressure wave/oscillation is for fracturing a formation surrounding the wellbore.

A twenty-seventh embodiment can include the system of any of the fifteenth through twenty-sixth embodiments, wherein the pressure wave/pulse is for diagnosing a formation surrounding the wellbore.

A twenty-eighth embodiment can include the system of any of the fifteenth through twenty-seventh embodiments, wherein the pressure wave is a pulse.

A twenty-eighth embodiment can include the system of any of the fifteenth through twenty-eighth embodiments, wherein the pressure wave causes a response from a formation surrounding the wellbore, the system further comprises a sensor configured to detect the response, and output a signal based on the detected response, and the processor is further configured to receive the signal, and analyze the signal to determine a characteristic of the formation, wherein a fracking operation of the well is altered based on the determined characteristic.

In a twenty-ninth embodiment, a system for hydraulic fracturing comprises a pump configured to pump fluid in a wellbore of a well to fracture a formation surrounding a horizontal portion of the wellbore; and a processor configured to control an oscillation of a flow rate of the pump to alternate between a first frequency and a second frequency, wherein the first frequency is below a natural frequency of the formation and the second frequency is above the natural frequency of the formation.

A thirtieth embodiment can include the system of the twenty-ninth embodiment, wherein the increase from the first frequency to the second frequency occurs over a duration, wherein the duration is greater than one hour.

A thirty-first embodiment can include the system of the twenty-ninth embodiment or the thirtieth embodiment, wherein the oscillation has a period of greater than ten seconds and less than one minute.

A thirty-second embodiment can include the system of any of the twenty-ninth through thirty-first embodiments, wherein the system further comprises a sensor disposed in the wellbore and configured to detect a response to the oscillation of the flow rate, and wherein the processor is further configured to estimate the natural frequency of the formation based on the detected response, and control the pump to match the estimated natural frequency of the formation.

A thirty-third embodiment can include the system of any of the twenty-ninth through thirty-second embodiments, wherein the processor is further configured to control the pump to add a pulse to the oscillation, wherein the system further comprises a sensor disposed in the wellbore and configured to detect a response to the pulse, and wherein the processor is further configured to estimate the natural frequency of the formation based on the detected response, and the control pump to match the estimated natural frequency of the formation.

A thirty-fourth embodiment can include the system of any of the twenty-ninth through thirty-third embodiments, wherein the oscillation comprises a sine wave.

A thirty-fifth embodiment can include the system of any of the twenty-ninth through thirty-fourth embodiments, wherein the pulse is a square pulse.

A thirty-sixth embodiment can include the system of any of the twenty-ninth through thirty-fifth embodiments, wherein the pulse is a triangle pulse.

A thirty-seventh embodiment can include the system of any of the twenty-ninth through thirty-sixth embodiments, wherein the pulse is a saw pulse.

A thirty-eighth embodiment can include the system of any of the twenty-ninth through thirty-seventh embodiments, wherein the pulse occurs over a duration of less than one minute.

A thirty-ninth embodiment can include the system of any of the twenty-ninth through thirty-eighth embodiments, wherein the pulse occurs over a duration of less than one second.

A fortieth embodiment can include the system of any of the twenty-ninth through thirty-ninth embodiments, wherein the pulse is caused at least in part by a transmission clutch of an engine driven pump disengaging.

A forty-first embodiment can include the system of any of the twenty-ninth through fortieth embodiments, wherein the pump is an electric driven pump.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Disclosure of a singular element should be understood to provide support for a plurality of the element. It is contemplated that elements of the present disclosure may be duplicated in any suitable quantity.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" does not require selection of only one element. Thus, the phrase "A or B" is satisfied by either one or both elements from the set {A, B}, including multiples of either element; and the phrase "A, B, or C" is satisfied by any element from the set {A, B, C} or any combination thereof, including multiples of any element. A clause that recites "A, B, or C" can be infringed with only one of the listed items, multiple of the listed items, and one or more of the items in the list and another item not listed.

As used herein, the article "a" means "one or more." As used herein, the article "an" means "one or more." As used herein, the article "the" when referring to a singular noun means "the one or more." Thus, the phrase "an element" means "one or more elements;" and the phrase "the element" means "the one or more elements."

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A system for monitoring hydraulic fracturing of a well, comprising:

one or more pumps configured to generate a pressure wave in a wellbore of the well, wherein the pressure wave comprises an oscillation of a flow rate output by the one or more pumps, wherein the oscillation sweeps between a first frequency and a second frequency, wherein the first frequency is below a natural frequency of a formation surrounding the wellbore, wherein the second frequency is above the natural frequency, and wherein the pressure wave causes a response from the formation;

a sensor configured to detect the response, and output a signal based on the detected response; and a processor configured to receive the signal, and analyze the signal to determine a characteristic of the formation, wherein a fracking operation of the well is altered based on the determined characteristic.

2. The system of claim 1, wherein the pressure wave is-further comprises a pulse.

3. The system of claim 2, wherein the one or more pumps comprise an electrically driven pump, and the pulse is generated by increasing a number of generators supplying power to the electrically driven pump.

4. The system of claim 2, wherein the one or more pumps comprise electrically driven pumps, and the pulse is generated by ramping up a flow rate of the electrically driven pumps by increasing an amount of available power to the electrically driven pumps by 200% or more.

5. The system of claim 1, wherein the response is caused by the pressure wave reflecting off of the formation.

6. The system of claim 1, wherein the one or more pumps comprise an electrically driven pump, and the pressure wave is generated by modulating a flow rate output by the electrically driven pump.

7. The system of claim 6, wherein the electrically driven pump is electrically coupled to a plurality of generators.

8. The system of claim 1, wherein the one or more pumps comprise an engine driven pump, and the pressure wave is generated by modulating a flow rate output by the engine driven pump.

9. The system of claim 1, wherein the one or more pumps comprise an engine driven pump disposed at a surface of the well and an electric driven pump disposed at the surface of the well, and wherein a combined output of the engine driven pump and the electric driven pump forms the pressure wave.

10. The system of claim 1, wherein the pressure wave further comprises an oscillation at a natural frequency of the formation.

11. The system of claim 1, wherein the pressure wave is generated by modulating amplitude, frequency, phase-shift, rate-of-change flow, wave form shape, duration, or period.

12. The system of claim 1, wherein the one or more pumps are disposed at a surface of the well, the formation is disposed proximate to a horizontal portion of the wellbore, and the one or more pumps are configured to fracture the formation.

13. The system of claim 1, wherein the characteristic is a degree of fracturing of the formation.

14. The system of claim 1, wherein the one or more pumps comprise an electrically driven pump and an engine driven pump, and the processor is further configured to control the electrically driven pump to output a pressure oscillation such that a maximum rate of change of current demanded by the electrically driven pump during the oscillation is less than a maximum rate of change of current a power supply electrically coupled to the electrically driven pump is capable of providing, and control the engine driven pump to output a pressure pulse during the oscillation.

15. A system for sending a diagnostic pressure signal into a well, comprising:

an electrically driven pump fluidly coupled to a wellbore of the well;

a power supply electrically coupled to the electrically driven pump;

an engine driven pump fluidly coupled to the wellbore; and a controller configured to control the electrically driven pump to output a pressure oscillation such that a maximum rate of change of current demanded by the electrically driven pump during the oscillation is less than a maximum rate of change of current the power supply is capable of providing, and control the engine driven pump to output a pressure pulse during the oscillation.

16. The system of claim 15, wherein the pressure pulse causes a response from a formation surrounding the wellbore, the system further comprises a sensor configured to detect the response, and output a signal based on the detected response, and the controller is further configured to receive the signal, analyze the signal to determine a characteristic of the formation, and adjust the oscillation based on the determined characteristic.

17. The system of claim 15, wherein the oscillation sweeps between a first frequency and a second frequency, and the first frequency is below a natural frequency of a formation surrounding the wellbore and the second frequency is above the natural frequency of the formation.

18. A system for hydraulic fracturing, comprising:

a pump system configured to pump fluid in a wellbore of a well to fracture a formation surrounding a horizontal portion of the wellbore; and a controller configured to control an oscillation of a flow rate of the pump system to sweep between a first frequency and a second frequency, wherein the first frequency is below a natural frequency of the formation and the second frequency is above the natural frequency of the formation.

19. The system of claim 18, further comprising a sensor disposed in the wellbore and configured to detect a response to the oscillation of the flow rate, wherein the controller is further configured to estimate the natural frequency of the formation based on the detected response, and control the pump system to match the estimated natural frequency of the formation.

20. The system of claim 18, wherein the pump system comprises an electrically driven pump configured to pump fluid in the wellbore and an engine driven pump configured to pump fluid in the wellbore, and the controller is further configured to control the electrically driven pump to output a pressure oscillation such that a maximum rate of change of current demanded by the electrically driven pump during the pressure oscillation is less than a maximum rate of change of current a power supply electrically coupled to the electric driven pump is capable of providing, and control the engine driven pump to output a pressure pulse during the pressure oscillation.

21. A system for monitoring hydraulic fracturing of a well, comprising:

an apparatus comprising an electrically driven pump and an engine driven pump, and configured to generate a pressure wave comprising a pressure oscillation and a pressure pulse into a wellbore of the well, wherein the pressure wave causes a response from a formation surrounding the wellbore;

a processor configured to control the electrically driven pump to output the pressure oscillation such that a maximum rate of change of current demanded by the electrically driven pump during the oscillation is less than a maximum rate of change of current a power supply electrically coupled to the electrically driven pump is capable of providing, and control the engine driven pump to output the pressure pulse during the oscillation; and a sensor configured to detect the response, and output a signal based on the detected response, wherein the processor is further configured to receive the signal, and analyze the signal to determine a characteristic of the formation, and wherein a fracking operation of the well is altered based on the determined characteristic.

22. A system for monitoring hydraulic fracturing of a well, comprising:

an electrically driven pump configured to generate a pulse in a wellbore of the well, wherein the pulse is generated by increasing a number of generators supplying power to the electrically driven pump, and wherein the pulse causes a response from a formation surrounding the wellbore;

a sensor configured to detect the response, and output a signal based on the detected response; and a processor configured to receive the signal, and analyze the signal to determine a characteristic of the formation, wherein a fracking operation of the well is altered based on the determined characteristic.

23. A system for monitoring hydraulic fracturing of a well, comprising:

electrically driven pumps configured to generate a pulse in a wellbore of the well, wherein the pulse is generated by ramping up a flow rate of the electrically driven pumps by increasing an amount of available power to the electrically driven pumps by 200% or more, and wherein the pulse causes a response from a formation surrounding the wellbore;

a sensor configured to detect the response, and output a signal based on the detected response; and a processor configured to receive the signal, and analyze the signal to determine a characteristic of the formation, wherein a fracking operation of the well is altered based on the determined characteristic.

* * * * *